US008205680B2

(12) United States Patent
Cook et al.

(10) Patent No.: US 8,205,680 B2
(45) Date of Patent: Jun. 26, 2012

(54) EXPANDABLE CONNECTION

(75) Inventors: Robert Lance Cook, Katy, TX (US); David Paul Brisco, Duncan, OK (US); R. Bruce Stewart, Rijswijk (NL); Robert Donald Mack, Wassenaar (NL); Lev Ring, Houston, TX (US); Alan Duell, Duncan, OK (US); Andrei Filippov, Houston, TX (US); Richard Carl Haut, The Woodlands, TX (US); Mark Shuster, Houston, TX (US)

(73) Assignee: Enventure Global Technology, LLC, Houston, TX (US)

( * ) Notice: Subject to any disclaimer, the term of this patent is extended or adjusted under 35 U.S.C. 154(b) by 1080 days.

(21) Appl. No.: 10/597,132

(22) PCT Filed: Jan. 12, 2004

(86) PCT No.: PCT/US2004/000631

§ 371 (c)(1),
(2), (4) Date: May 8, 2009

(87) PCT Pub. No.: WO2005/071212

PCT Pub. Date: Aug. 4, 2005

(65) Prior Publication Data

US 2009/0205839 A1 Aug. 20, 2009

Related U.S. Application Data

(60) Provisional application No. 60/438,838, filed on Jan. 9, 2003.

(51) Int. Cl.
*E21B 17/02* (2006.01)

(52) U.S. Cl. ..... 166/380; 166/207; 166/242.6; 228/194

(58) Field of Classification Search ..... 166/380, 166/382, 242.6, 206, 207; 175/320; 228/194; 285/21.2, 21.3, 21.1, 288.3, 288.11, 289.5
See application file for complete search history.

(56) References Cited

U.S. PATENT DOCUMENTS

| | | | |
|---|---|---|---|
| 2,145,168 | A | 1/1939 | Flagg |
| 2,788,231 | A | 4/1957 | Crow |
| 3,195,928 | A | 7/1965 | Pasternack |
| 3,427,707 | A | 2/1969 | Nowosadko |
| 3,500,264 | A | 3/1970 | Floyd, Jr. |
| 3,709,306 | A | 1/1973 | Curington |
| 4,468,309 | A | 8/1984 | White |
| 4,758,025 | A | 7/1988 | Frick |

(Continued)

FOREIGN PATENT DOCUMENTS

| | | | |
|---|---|---|---|
| SU | 1194993 | A | 11/1985 |

(Continued)

OTHER PUBLICATIONS

International Search Report dated Jul. 3, 2001 for International Application Serial No. PCT/EP01/03641.

(Continued)

*Primary Examiner* — Hoang Dang
(74) *Attorney, Agent, or Firm* — Edmonds & Nolte, PC; Derek V. Forinash

(57) ABSTRACT

An expandable tubular liner includes a first tube, a second tube, a mechanical coupling for coupling the first and second tubes, and an insert coupled to the mechanical coupling. The insert is capable of forming a metallurgical bond with at least one of the tubes when energy is injected into the insert.

14 Claims, 13 Drawing Sheets

U.S. PATENT DOCUMENTS 4,962,579 A 10/1990 Moyer et al.
5,064,004 A 11/1991 Lundell
5,699,955 A 12/1997 Shimizu et al.
5,924,745 A 7/1999 Campbell
6,322,109 B1 11/2001 Campbell et al.
6,409,175 B1 6/2002 Evans et al.
6,419,147 B1 7/2002 Daniel
6,550,821 B2 4/2003 DeLange et al.
6,554,287 B1 4/2003 Sivley, IV et al.
6,564,875 B1 5/2003 Bullock
6,604,763 B1 8/2003 Cook et al.
6,607,220 B2 8/2003 Sivley, IV
6,619,696 B2 9/2003 Baugh et al.
6,712,401 B2 3/2004 Coulon et al.
6,767,035 B2 7/2004 Hashem
6,789,822 B1 9/2004 Metcalfe
6,851,727 B2 2/2005 Carcagno et al.
6,905,150 B2 6/2005 Carcagno et al.
6,907,652 B1 6/2005 Heijnen
6,968,618 B2 11/2005 Cook et al.
6,971,685 B2 12/2005 Hashem
6,976,711 B2 12/2005 Sivley, IV
6,981,547 B2 1/2006 Maguire et al.
6,997,264 B2 2/2006 Simpson et al.
7,017,950 B2 3/2006 Macaulay
7,025,135 B2 4/2006 Ellington et al.
7,040,396 B2 5/2006 Cook et al.
7,077,197 B2 7/2006 Harrall
7,086,669 B2 8/2006 Evans et al.
7,107,663 B2 9/2006 Ellington et al.
7,125,053 B2 10/2006 Hashem
7,140,446 B2 11/2006 Metcalfe
7,159,667 B2 1/2007 Cook et al.
7,225,523 B2 6/2007 Metcalfe
7,240,928 B2 7/2007 Evans et al.
7,246,667 B2 7/2007 Cook et al.
7,255,374 B2 8/2007 Carcagno et al.
7,377,326 B2 5/2008 Shuster et al.
7,380,839 B2 6/2008 Ellington et al.
7,380,840 B2 6/2008 Sivley, IV et al.
7,404,444 B2 7/2008 Costa et al.
7,419,193 B2 9/2008 Simpson
7,424,918 B2 9/2008 Shuster et al.
7,452,007 B2 11/2008 Hashem et al.
7,464,449 B2 12/2008 Santi et al.
7,469,938 B2 12/2008 Sivley, IV
7,478,844 B2 1/2009 Hashem
7,503,395 B2 3/2009 Meijer et al.
2003/0067166 A1 4/2003 Sivley, IV
2003/0075338 A1 4/2003 Sivley, IV
2003/0107217 A1 6/2003 Daigle et al.
2003/0197376 A1 10/2003 Sivley, IV
2003/0222409 A1 12/2003 Sivley, IV et al.
2004/0060706 A1 4/2004 Stephenson
2005/0012278 A1 1/2005 DeLange
2005/0081358 A1 4/2005 Cook et al.
2005/0285398 A1 12/2005 Sivley, IV
2006/0032640 A1 2/2006 Costa et al.
2006/0090902 A1 5/2006 Costa et al.
2006/0113085 A1 6/2006 Costa et al.
2006/0162937 A1 7/2006 Costa et al.
2006/0208488 A1 9/2006 Costa
2006/0213668 A1 9/2006 Cook et al.
2007/0029797 A1 2/2007 Santi et al.
2007/0035127 A1 2/2007 Benzie
2007/0035131 A1 2/2007 Benzie
2007/0035132 A1 2/2007 Benzie
2007/0039742 A1 2/2007 Costa
2007/0102927 A1 5/2007 Dubedout et al.
2007/0246934 A1 10/2007 Heertjes et al.
2007/0257486 A1 11/2007 Filippov et al.
2007/0272419 A1 11/2007 Costa et al.
2007/0278788 A1 12/2007 Costa
2008/0018099 A1 1/2008 Costa
2008/0042428 A1 2/2008 Costa
2008/0066927 A1 3/2008 Costa et al.
2008/0066930 A1 3/2008 Costa et al.
2008/0100064 A1 5/2008 Costa
2008/0136181 A1 6/2008 Costa
2008/0144759 A1 6/2008 Cook et al.
2009/0038138 A1 2/2009 Costa

FOREIGN PATENT DOCUMENTS

WO 98/33619 A1 8/1998

OTHER PUBLICATIONS

International Search Report dated Mar. 28, 2005 for International Application Serial No. PCT/US04/00631.
Combined Search and Examination Report dated Jan. 31, 2008 for Serial No. GB0725046.7.

EXPANDABLE CONNECTION

CROSS REFERENCE TO RELATED APPLICATIONS

The present application is the National Stage patent application for PCT patent application serial number PCT/US2004/000631, filed on Jan. 12, 2004, which claims the benefit of the filing date of U.S. provisional patent application Ser. No. 60/438,838, filed on Jan. 9, 2003, the disclosure of which is incorporated herein by reference.

This application is related to the following co-pending applications, and all continuations, divisionals, and corresponding utility applications: (1) U.S. Pat. No. 6,328,113, which was filed as U.S. patent application Ser. No. 09/440,338, filed on Nov. 15, 1999, which claims priority from provisional application 60/108,558, filed on Nov. 16, 1998; (2) U.S. Pat. No. 6,497,289, which was filed as U.S. patent application Ser. No. 09/454,139, filed on Dec. 3, 1999, which claims priority from provisional application 60/111,293, filed on Dec. 7, 1998; (3) U.S. patent application Ser. No. 09/502,350, filed on Feb. 10, 2000, which claims priority from provisional application 60/119,611, filed on Feb. 11, 1999, (4) U.S. patent application Ser. No. 09/510,913, filed on Feb. 23, 2000, which claims priority from provisional application 60/121,702, filed on Feb. 25, 1999, (5) U.S. Pat. No. 6,568,471, which was filed as patent application Ser. No. 09/512,895, filed on Feb. 24, 2000, which claims priority from provisional application 60/121,841, filed on Feb. 26, 1999, (6) U.S. Pat. No. 6,575,240, which was filed as patent application Ser. No. 09/511,941, filed on Feb. 24, 2000, which claims priority from provisional application 60/121,907, filed on Feb. 26, 1999, (7) U.S. Pat. No. 6,640,903 which was filed as U.S. patent application Ser. No. 09/523,468, filed on Mar. 10, 2000, which claims priority from provisional application 60/124,042, filed on Mar. 11, 1999, (8) U.S. Pat. No. 6,604,763, which was filed as application Ser. No. 09/559,122, filed on Apr. 26, 2000, which claims priority from provisional application 60/131,106, filed on Apr. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. provisional patent application Ser. No. 60/143,039, filed on Jul. 9, 1999, (11) U.S. patent application Ser. No. 10/030,593, filed on Jan. 8, 2002, which claims priority from provisional application 60/146,203, filed on Jul. 29, 1999, Applicants incorporate by reference the disclosures of the above applications.

This application is related to the following co-pending applications: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. Pat. No. 6,640,903 which was filed as U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/322,947, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No.

60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (44) PCT application US02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US02/36157, filed on Nov. 12, 2002, which claims priority from U.S. provisional patent application Ser. No. 60/338,996, filed on Nov. 12, 2001, (63) PCT application US02/36267, filed on Nov. 12, 2002, which claims priority from U.S. provisional patent application Ser. No. 60/339,013, filed on Nov. 12, 2001, (64) PCT application US03/11765, filed on Apr. 16, 2003, which claims priority from U.S. provisional patent application Ser. No. 60/383,917, filed on May 29, 2002, (65) PCT application US03/15020, filed on May 12, 2003, which claims priority from U.S. provisional patent application Ser. No. 60/391,703, filed on Jun. 26, 2002, (66) PCT application US02/39418, filed on Dec. 10, 2002, which claims priority from U.S. provisional patent application Ser. No. 60/346,309, filed on Jan. 7, 2002, (67) PCT application US03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application U.S. 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US03/14153, filed on May 6, 2003, which claims priority from U.S. provisional patent application Ser. No. 60/380,147, filed on May 6, 2002, (77) PCT application US03/19993, filed on Jun. 24, 2003, which claims priority from U.S. provisional patent application Ser. No. 60/397,284, filed on Jul. 19, 2002, (78) PCT application US03/13787, filed on May 5, 2003, which claims priority from U.S. provisional patent application Ser. No. 60/387,486, filed on Jun. 10, 2002, (79) PCT application US03/18530, filed on Jun. 11, 2003, which claims priority from U.S. provisional patent application Ser. No. 60/387,961, filed on Jun. 12, 2002, (80) PCT application US03/20694, filed on Jul. 1, 2003, which claims priority from U.S. provisional patent application Ser. No. 60/398,061, filed on Jul. 24, 2002, (81) PCT application US03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, which was filed on Apr. 18, 2003, as a division of U.S. utility patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999; (122) PCT patent application Ser. No. PCT/US2004/06246, filed on Feb. 26, 2004; (123) PCT patent application serial number PCT/US2004/08170, filed on Mar. 15, 2004; (124) PCT patent application serial number PCT/US2004/08171, filed on Mar. 15, 2004; (125) PCT patent application serial number PCT/US2004/08073, filed on Mar. 18, 2004; (126) PCT patent application serial number PCT/US2004/07711, filed on Mar. 11, 2004; (127) PCT patent application serial number PCT/US2004/029025, filed on Mar. 26, 2004; (128) PCT patent application serial number PCT/US2004/010317, filed on Apr. 2, 2004; (129) PCT patent application serial number PCT/US2004/010712, filed on Apr. 6, 2004; (130) PCT patent application serial number PCT/US2004/010762, filed on Apr. 6, 2004; (131) PCT patent application serial number PCT/US2004/011973, filed on Apr. 15, 2004; (132) U.S. provisional patent application Ser. No. 60/495,056, filed on Aug. 14, 2003; (133) U.S. provisional patent application Ser. No. 60/600,679, filed on Aug. 11, 2004; (134) PCT patent application serial number PCT/US2005/027318, filed on Jul. 29, 2005; (135) PCT patent application serial number PCT/US2005/028936, filed on Aug. 12, 2005; (136) PCT patent application serial number PCT/US2005/028669, filed on Aug. 11, 2005; (137) PCT patent application serial number PCT/US2005/028453, filed on Aug. 11, 2005; (138) PCT patent application serial number PCT/US2005/028641, filed on Aug. 11, 2005; (139) PCT patent application serial number PCT/US2005/028819, filed on Aug. 11, 2005; (140) PCT patent application serial number PCT/US2005/028446, filed on Aug. 11, 2005; (141) PCT patent application serial number PCT/US2005/028642, filed on Aug. 11, 2005; (142) PCT patent application serial number PCT/US2005/028451, filed on Aug. 11, 2005, and (143). PCT patent application serial number PCT/US2005/028473, filed on Aug. 11, 2005, (144) U.S. utility patent application Ser. No. 10/546,082, filed on Aug. 16, 2005, (145) U.S. utility patent application Ser. No. 10/546,076, filed on Aug. 16, 2005, (146) U.S. utility patent application Ser. No. 10/545,936, filed on Aug. 16, 2005, (147) U.S. utility patent application Ser. No. 10/546,079, filed on Aug. 16, 2005 (148) U.S. utility patent application Ser. No. 10/545,941, filed on Aug. 16, 2005, (149) U.S. utility patent application serial number 546078, filed on Aug. 16, 2005, filed on Aug. 11, 2005, (150) U.S. utility patent application Ser. No. 10/545,941, filed on Aug. 16, 2005, (151) U.S. utility patent application Ser. No. 11/249,967, filed on Oct. 13, 2005, (152) U.S. provisional patent application Ser. No. 60/734,302, filed on Nov. 7, 2005, (153) U.S. provisional patent application Ser. No. 60/725,181, filed on Oct. 11, 2005, (154) PCT patent application serial number PCT/US2005/023391, filed Jun. 29, 2005 which claims priority from U.S. provisional patent application Ser. No. 60/585,370, filed on Jul. 2, 2004, (155) U.S. provisional patent application Ser. No. 60/721,579, filed on Sep. 28, 2005, (156) U.S. provisional patent application Ser. No. 60/717,391, filed on Sep. 15, 2005, (157) U.S. provisional patent application Ser. No. 60/702,935, filed on Jul. 27, 2005, (158) U.S. provisional patent application Ser. No. 60/663,913, filed on Mar. 21, 2005, (159) U.S. provisional patent application Ser. No. 60/652,564, filed on Feb. 14, 2005, (160) U.S. provisional patent application Ser. No. 60/645,840, filed on Jan. 21, 2005, (161) PCT patent application serial number PCT/US2005/043122, filed on Nov. 29, 2005 which claims priority from U.S. provisional patent application Ser. No. 60/631,703, filed on Nov. 30, 2004, (162) U.S. provisional patent application Ser. No. 60/752,787, filed on Dec. 22, 2005, (163) U.S. National Stage application Ser. No. 10/548,934, filed on Sep. 12, 2005; (164) U.S. National Stage application Ser. No. 10/549,410, filed on Sep. 13, 2005; (165) U.S. Provisional Patent Application No. 60/717,391, filed on Sep. 15, 2005; (166) U.S. National Stage application Ser. No. 10/550,906, filed on Sep. 27, 2005; (167) U.S. National Stage application Ser. No. 10/551,880, filed on Sep. 30, 2005; (168) U.S. National Stage application Ser. No. 10/552,253, filed on Oct. 4, 2005; (169) U.S. National Stage application Ser. No. 10/552,790, filed on Oct. 11, 2005; (170) U.S. Provisional Patent Application No. 60/725,181, filed on Oct. 11, 2005; (171) U.S. National Stage application Ser. No. 10/553,094, filed on Oct. 13, 2005; (172) U.S. National Stage application Ser. No. 10/553,566, filed on Oct. 17, 2005; (173) PCT Patent Application No. PCT/US2006/002449, filed on Jan. 20, 2006, and (174) PCT Patent Application No. PCT/US2006/004809, filed on Feb. 9, 2006; (175) U.S. Utility patent application Ser. No. 11/356,899, filed on Feb. 17, 2006, (176) U.S. National Stage application Ser. No. 10/568,200, filed on Feb. 13, 2006, (177) U.S. National Stage application Ser. No. 10/568,719, filed on Feb. 16, 2006, filed on Feb. 16, 2006, (178) U.S. National Stage application Ser. No. 10/569,323, filed on Feb. 17, 2006, (179) U.S. National State patent application Ser. No. 10/571,041, filed on Mar. 3, 2006; (180) U.S. National State patent application Ser. No. 10/571,017, filed on Mar. 3, 2006; (181) U.S. National State patent application Ser. No. 10/571,086, filed on Mar. 6, 2006; and (182) U.S. National State patent application Ser. No. 10/571,085, filed on Mar. 6, 2006, (183) U.S. utility patent application Ser. No. 10/938,788, filed on Sep. 10, 2004, (184) U.S. utility patent application Ser. No. 10/938,225, filed on Sep. 10, 2004, (185) U.S. utility patent application Ser. No. 10/952,288, filed on Sep. 28, 2004, (186) U.S. utility patent application Ser. No. 10/952,416, filed on Sep. 28, 2004, (187) U.S. utility patent application Ser. No. 10/950,749, filed on Sep. 27, 2004, (188) U.S. utility patent application Ser. No. 10/950,869, filed on Sep. 27, 2004; (189) U.S. provisional patent application Ser. No. 60/761,324, filed on Jan. 23, 2006, (190) U.S. provisional patent application Ser. No. 60/754,556, filed on Dec. 28, 2005, (191) U.S. utility patent application Ser. No. 11/380,051, filed on Apr. 25, 2006, and (192) U.S. utility patent application Ser. No. 11/380,055, filed on Apr. 25, 2006.

BACKGROUND OF THE INVENTION

This invention relates generally to wellbore casings, and in particular to wellbore casings that are formed using expandable tubing.

Conventionally, when a wellbore is created, a number of casings are installed in the borehole to prevent collapse of the borehole wall and to prevent undesired outflow of drilling fluid into the formation or inflow of fluid from the formation into the borehole. The casings are limited in length, often connected end-to-end by threaded connections.

Other inventions have disclosed a method of forming a wellbore casing that includes installing a tubular liner and a mandrel in the borehole, injecting fluid into the borehole, and radially expanding the liner in the borehole by extruding the liner off of the mandrel.

However, during the expansion, the tip ends of the threaded connections tend to peel away. The present invention is directed to overcoming this limitation of the expandable tubulars.

SUMMARY OF THE INVENTION

According to one aspect of the present invention, a method of radially expanding and plastically deforming a first tube having first threads, and a second tube having second threads is provided that includes coupling a first insert to the first threads, coupling the first threads to the second threads to form a threaded connection, heating the threaded connection sufficiently to melt at least a portion of the first insert, allowing the melted portion of the first insert to flow and solidify within the threaded connection, and radially expanding and plastically deforming the coupled first and second tubes.

According to another aspect of the present invention, an expandable tubular liner is provided including a first tube having first threads, and a second tube having second threads coupled to the first threads; wherein the first threads are coupled to the second threads by the process of: coupling a first insert to the first threads, coupling the first threads to the second threads, heating the first insert sufficiently to melt at least a portion of the first insert, and cooling the melted portion of the first insert.

According to another aspect of the present invention, an apparatus is provided that includes a preexisting structure coupled to a tubular liner, the tubular liner comprising a first tube including first threads, and a second tube including second threads, wherein the tubular liner is coupled to the preexisting structure by the process of: coupling a first insert to the first threads, coupling the first threads to the second threads to form a threaded connection, heating the threaded connection sufficiently to melt at least a portion of the first insert, allowing the melted portion of the first insert to flow and solidify within the threaded connection, positioning the coupled first and second tubes within a preexisting structure, and radially expanding the coupled first and second tubes into contact with the preexisting structure.

According to another aspect of the present invention, a method of radially expanding and plastically deforming a first tube having first threads, and a second tube having second threads is provided that includes coupling a first insert to the first threads, coupling the first threads to the second threads to form a threaded connection, and radially expanding and plastically deforming the coupled first and second tubes and forming a metallurgical bond between the first insert and at least one of the first and second tubes.

According to another aspect of the present invention, an expandable tubular liner is provided that includes a first tube having first threads, and a second tube having second threads coupled to the first threads; wherein the first threads are metallurgically bonded to the second threads by the process of: coupling a first insert to the first threads, coupling the first threads to the second threads, and radially expanding and plastically deforming the coupled first and second tubes.

According to another aspect of the present invention, an apparatus is provided that includes a preexisting structure coupled to a tubular liner, the tubular liner comprising a first tube including first threads, and a second tube including second threads, wherein the tubular liner is coupled to the preexisting structure by the process of: coupling a first insert to the first threads, coupling the first threads to the second threads to form a threaded connection, and radially expanding the coupled first and second tubes into contact with the preexisting structure and forming a metallurgical bond between the first insert and at least one of the first and second tubes.

According to another aspect of the present invention, A method of radially expanding and plastically deforming a first tube, a second tube, and a mechanical connection for coupling the first and second tubes is provided that includes coupling an insert to at least one of the first and second tubes, coupling the first and second tubes together using the mechanical connection, radially expanding and plastically deforming the coupled first and second tubes, and forming a metallurgical bond between the insert and at least one of the first and second tubes by injecting energy into the insert prior to or during the radial expansion and plastic deformation of the first and second tubes.

According to another aspect of the present invention, a method of radially expanding and plastically deforming a first tube, a second tube, and a mechanical connection for coupling the first and second tubes is provided that includes coupling an insert to at least one of the first and second tubes, coupling the first and second tubes together using the mechanical connection, radially expanding and plastically deforming the coupled first and second tubes, and forming a metallurgical bond between the insert and at least one of the first and second tubes by injecting energy into the insert prior to and during the radial expansion and plastic deformation of the first and second tubes.

According to another aspect of the present invention, a tubular assembly is provided that includes a first tube, a second tube, a mechanical connection for coupling the first and second tubes, and a metallurgical connection for coupling the first and second tubes, wherein the metallurgical connection is provided proximate the mechanical connection.

According to another aspect of the present invention, a tubular assembly is provided that includes a first tube, a second tube, a mechanical connection for coupling the first and second tubes, and a metallurgical connection for coupling an external tubular surface of the first tube to an internal tubular surface of the second tube.

According to another aspect of the present invention, a tubular assembly is provided that includes a first tube, a second tube, a mechanical connection for coupling the first and second tubes, and a metallurgical connection for coupling an external surface of the first tube to an internal surface of the second tube, wherein the metallurgical connection is positioned within the mechanical connection.

According to another aspect of the present invention, a tubular assembly is provided that includes a first tube, a second tube, a threaded connection for coupling the first and second tubes, and a metallurgical connection for coupling an external surface of the first tube to an internal surface of the second tube, wherein the metallurgical connection is positioned within the threaded connection.

According to another aspect of the present invention, a cold-weldable insert for forming a metallurgical bond between overlapping threaded ends of adjacent tubular members is provided that includes a tapered tubular member comprising one or more threaded portions for engaging the threaded ends of the adjacent tubular members, wherein the tapered tubular member is fabricated from one or more materials capable of forming a metallurgical bond with at least one of the adjacent tubular members when energy is input into the tapered tubular member.

According to another aspect of the present invention, a method of radially expanding and plastically deforming a first tube having first threads, and a second tube having second threads is provided that includes coupling the first threads to the second threads to form a threaded connection, and radially expanding and plastically deforming the coupled first and second tubes and forming a metallurgical bond between the first and second tubes.

According to another aspect of the present invention, an expandable tubular liner is provided that includes a first tube having first threads, and a second tube having second threads coupled to the first threads; wherein the first threads are metallurgically bonded to the second threads by the process of: coupling the first threads to the second threads; and radially expanding and plastically deforming the coupled first and second tubes.

According to another aspect of the present invention, an apparatus is provided that includes a preexisting structure coupled to a tubular liner, the tubular liner comprising a first tube including first threads, and a second tube including second threads, wherein the tubular liner is coupled to the preexisting structure by the process of: coupling the first threads to the second threads to form a threaded connection, and radially expanding the coupled first and second tubes into contact with the preexisting structure and forming a metallurgical bond between the first insert and at least one of the first and second tubes.

According to another aspect of the present invention, a method of radially expanding and plastically deforming a first tube having first threads, and a second tube having second threads is provided that includes coupling the first threads to the second threads to form a threaded connection, and radially expanding and plastically deforming the coupled first and second tubes and forming a metallurgical bond between the first and second tubes.

According to another aspect of the present invention, an expandable tubular liner is provided that includes a first tube having first threads, and a second tube having second threads coupled to the first threads; wherein the first threads are metallurgically bonded to the second threads by the process of: coupling the first threads to the second threads, and radially expanding and plastically deforming the coupled first and second tubes.

According to another aspect of the present invention, an apparatus is provided that includes a preexisting structure coupled to a tubular liner, the tubular liner comprising a first tube including first threads, and a second tube including second threads, wherein the tubular liner is coupled to the preexisting structure by the process of: coupling the first threads to the second threads to form a threaded connection, and radially expanding the coupled first and second tubes into contact with the preexisting structure and forming a metallurgical bond between the first insert and at least one of the first and second tubes.

According to another aspect of the present invention, a method of radially expanding and plastically deforming a first tube, a second tube, and a mechanical coupling for coupling overlapping ends of the first and second tubes is provided that includes radially expanding and plastically deforming the coupled first and second tubes, and injecting energy into the coupled first and second tubes to form a metallurgical bond between the first and second tubes.

According to another aspect of the present invention, an expandable tubular liner is provided that includes a first tube, a second tube, and a mechanical coupling for coupling overlapping ends of the first and second tubes, wherein overlapping ends of the first and second tubes are metallurgically bonded by the process of: coupling the overlapping ends of the first and second tubes, radially expanding and plastically deforming the coupled first and second tubes, and injecting energy into the coupled first and second tubes.

According to another aspect of the present invention, an apparatus is provided that includes a preexisting structure coupled to a tubular liner, the tubular liner comprising a first tube, a second tube, and a mechanical coupling for coupling overlapping ends of the first and second tubes, wherein the tubular liner is coupled to the preexisting structure by the process of: radially expanding the coupled first and second tubes into contact with the preexisting structure, and injecting energy into the coupled first and second tubes to form a metallurgical bond between the first and second tubes.

According to another aspect of the present invention, a method of radially expanding and plastically deforming a first tube, a second tube, and a mechanical coupling for coupling overlapping ends of the first and second tubes is provided that includes positioning an insert material between the overlapping ends of the coupled first and second tubes, radially expanding and plastically deforming the coupled first and second tubes, injecting energy into the coupled first and second tubes before, during, or after the radial expansion and plastic deformation of the first and second tubes to lower a melting point of at least a portion of the insert material, and injecting thermal energy into the coupled first and second tubes to form a metallurgical bond between the insert material and at least one of the first and second coupled tubes.

According to another aspect of the present invention, an expandable tubular liner is provided that includes a first tube, a second tube, and a mechanical coupling for coupling overlapping ends of the first and second tubes, wherein overlapping ends of the first and second tubes are metallurgically bonded by the process of: positioning an insert material between the overlapping ends of the coupled first and second tubes, radially expanding and plastically deforming the coupled first and second tubes, injecting energy into the coupled first and second tubes before, during, or after the radial expansion and plastic deformation of the first and second tubes to lower a melting point of at least a portion of the insert material; and injecting thermal energy into the coupled first and second tubes to form a metallurgical bond between the insert material and the first and second coupled tubes.

According to another aspect of the present invention, an apparatus is provided that includes a preexisting structure coupled to a tubular liner, the tubular liner comprising a first tube, a second tube, and a mechanical coupling for coupling overlapping ends of the first and second tubes, wherein the tubular liner is coupled to the preexisting structure by the process of: positioning an insert material between the overlapping ends of the coupled first and second tubes, radially expanding and plastically deforming the coupled first and second tubes into engagement with the preexisting structure, injecting energy into the coupled first and second tubes before, during, or after the radial expansion and plastic deformation of the first and second tubes to lower a melting point of at least a portion of the insert material, and injecting thermal energy into the coupled first and second tubes to form a metallurgical bond between the insert material and the first and second coupled tubes.

DETAILED DESCRIPTION

Figure 1:
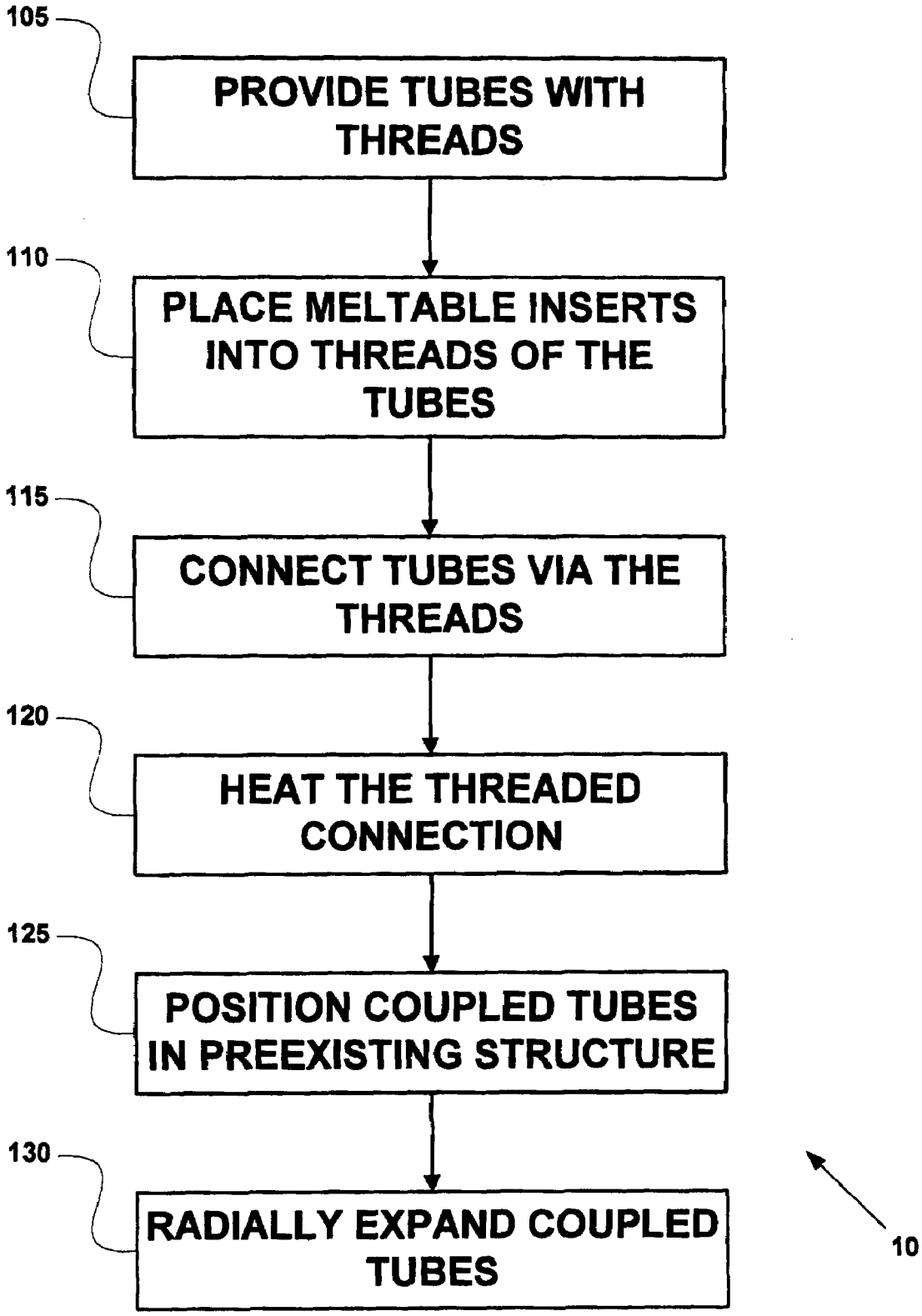
FIG. 1 is a flow chart illustrating an exemplary embodiment of a method for coupling a plurality of tubes to a preexisting structure.

In FIG. 1, an exemplary embodiment of a method 10 for forming and/or repairing a wellbore casing, pipeline, or structural support includes the steps of: (1) providing first and second tubes having first and second threads in step 105; (2) positioning a meltable insert into the first and second threads of the first and second tubes in step 110; (3) coupling the first and second threads of the first and second tubes to form a threaded connection in step 115; (4) heating the threaded connection in step 120; (5) positioning the coupled first and second tubes within a pre-existing structure in step 125; and (6) radially expanding the coupled first and second tubes into contact with the preexisting structure in step 130.

Figure 2:
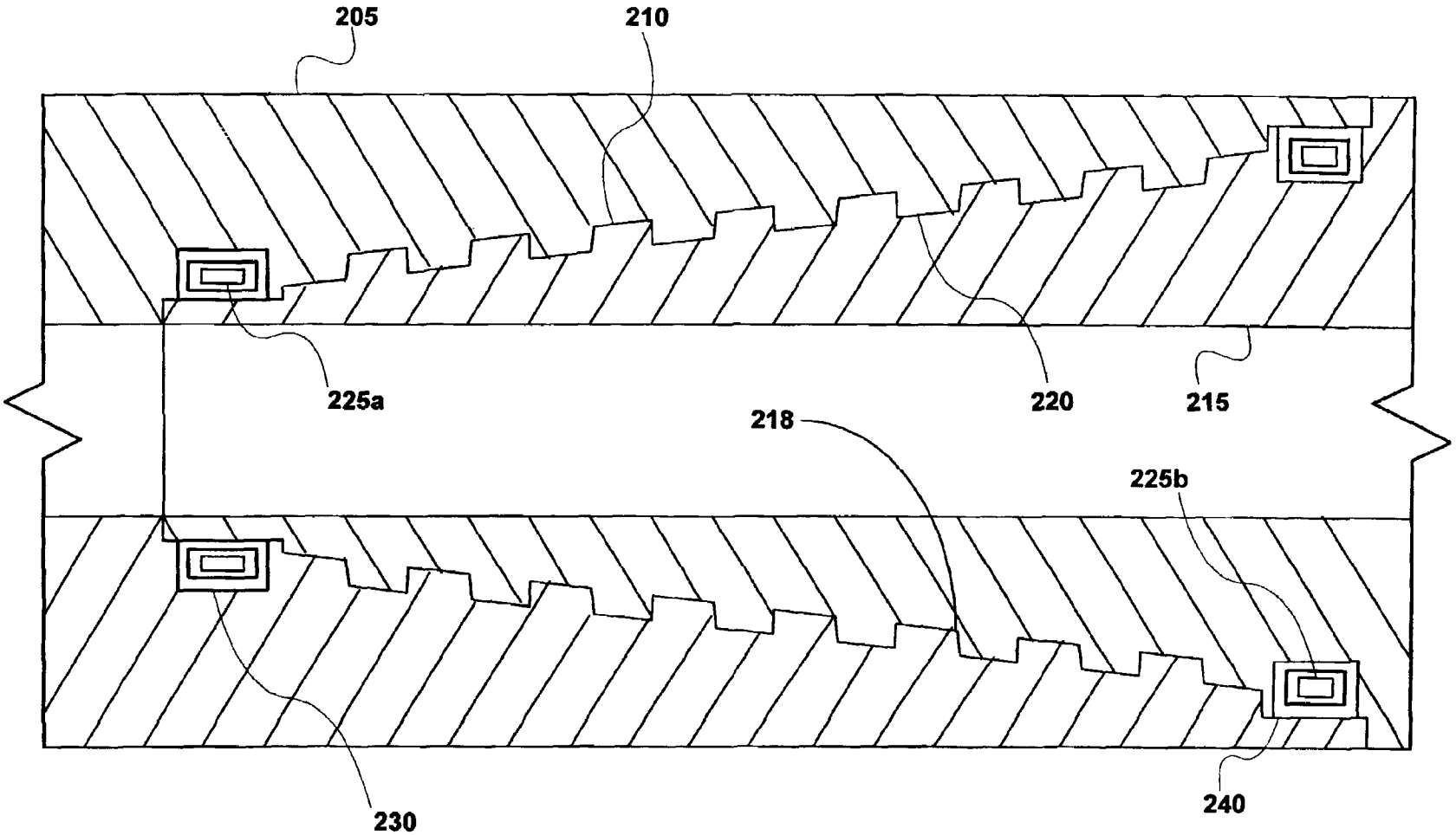
FIG. 2 is a cross-sectional illustration of an exemplary embodiment of the threaded connection between a pair of tubes, including meltable inserts.

As illustrated in FIG. 2, in steps 105, 110, and 115, a first tube 205 having first threads 210 is coupled to a second tube 215 having second threads 220. Once coupled, the tubes 205 and 215 form a threaded connection 218. The tubes 205 and 215 may comprise any number of conventional tubes. In an exemplary embodiment, the tubes 205 and 215 are oilfield country tubular goods or wellbore casings available from Lone Star Steel.

A first meltable insert 225*a* is preferably positioned within a first channel 230 provided in the first threads 210, and a second meltable insert 225*b* is preferably positioned within a second channel 240 provided in the second threads 220. The threads 210 and 220 may include any number of conventional commercially available threads. In an exemplary embodiment, the first and second threads, 210 and 220, are pin and box threads available from Grant Prideco. The channels 230 and 240 may be provided within any portion of the threads 210 and 220. In an exemplary embodiment, the channels 230 and 240 are provided adjacent to the end portions of the threads 210 and 220, in order to optimally position the meltable inserts, 225*a* and 225*b*.

Figure 3:
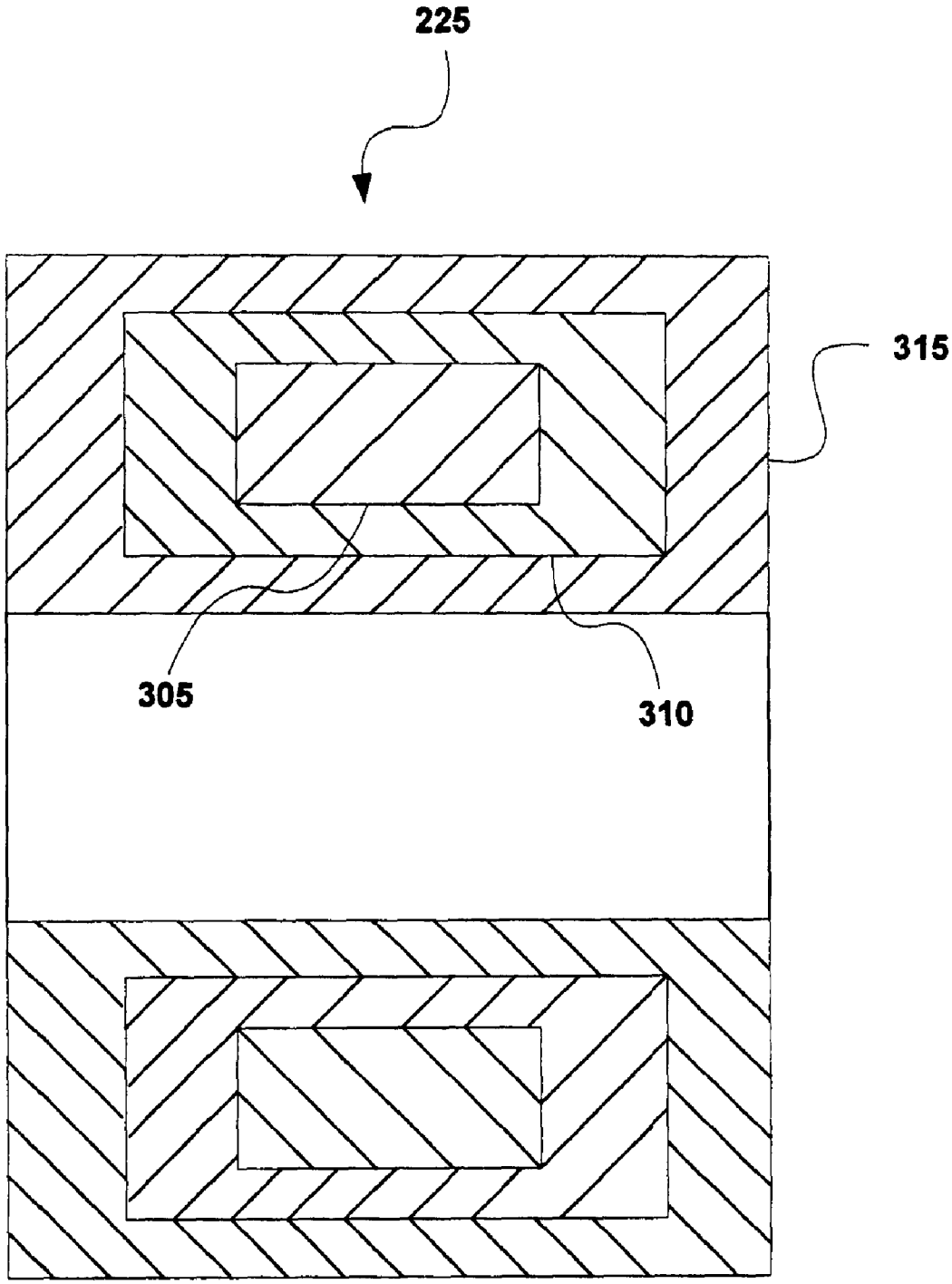
FIG. 3 is a cross-sectional illustration of an exemplary embodiment of the meltable inserts of FIG. 2.

The meltable inserts 225 may include any number of conventional commercially available meltable inserts. In an exemplary embodiment, as illustrated in FIG. 3, the meltable inserts 225 include an inner core 305, a layer of a meltable material 310, and an outermost layer of a flux 315. In an exemplary embodiment, the melting point of the meltable material 310 is less than the melting point of the inner core 305. In an exemplary embodiment, the inner core 305 is fabricated from, and/or includes alloys of, indium, aluminum, bismuth, cadmium, lead, tin, brass, or bronze, the meltable material 310 is fabricated from, and/or includes alloys of, indium, aluminum, bismuth, cadmium, lead, tin, brass, or bronze, and the flux is fabricated from, or includes, ammonium cetyl sulfate, saturated zinc chloride in hydrochloric aside, Amasan flux C66, or 157 flux. In an exemplary embodiment, the meltable inserts 225 are ring shaped.

In an exemplary embodiment, one or more of the inserts 225 include, or constitute, one or more of the BrazeCoat™, S-Bond™, and/or WideGap™ insert materials and products available from Material Resources International in Lansdale, Pa. and described, for example, at the following website: http://www.materialsresources.com.

Figure 4:
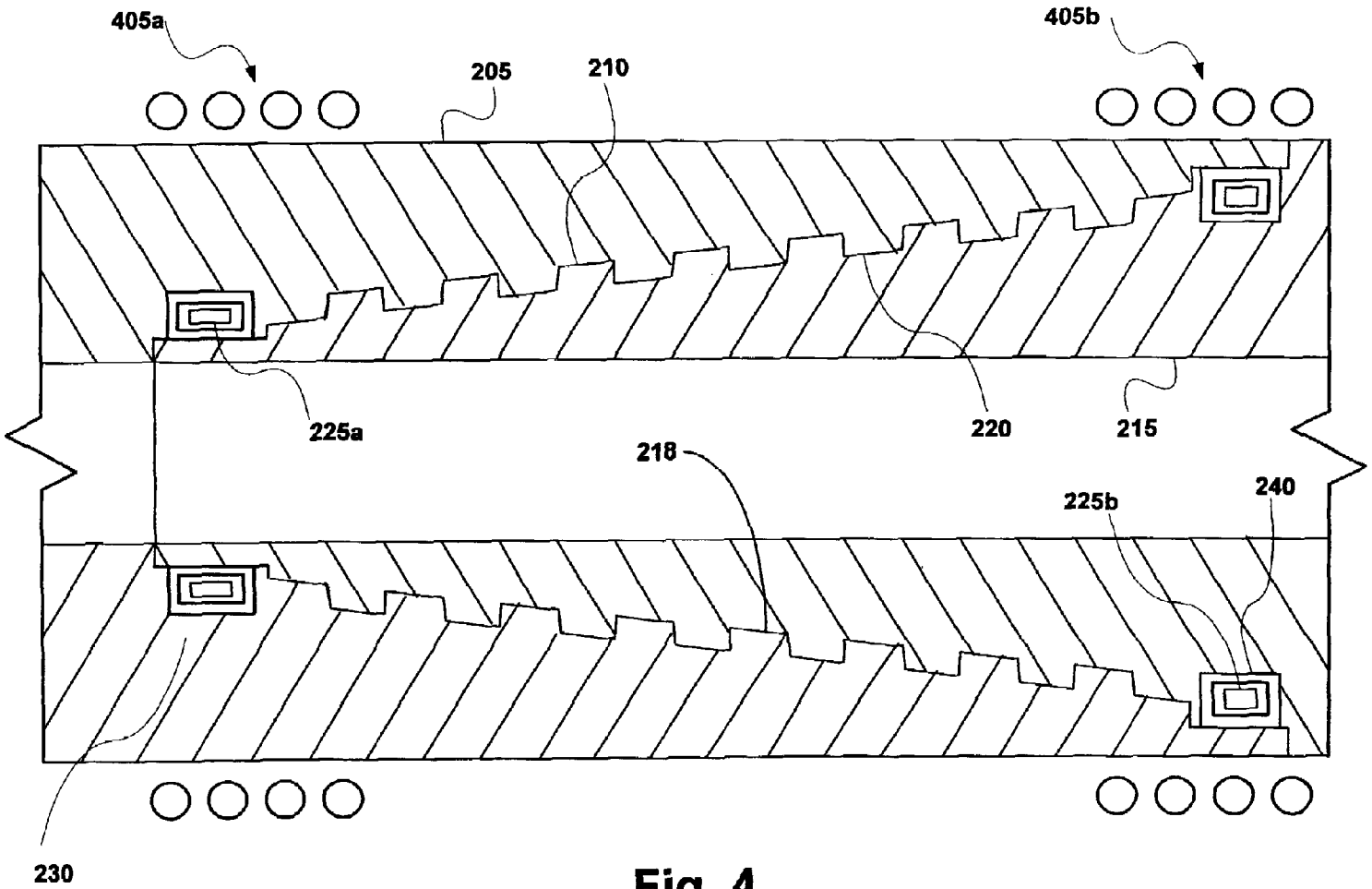
FIG. 4 is a cross-sectional illustration of the threaded connection of FIG. 2, illustrating the placement of induction heating coils near the locations of the meltable inserts.

As illustrated in FIG. 4, in step 120, the threaded connection 218 is heated using first and second induction coils, 405*a* and 405*b*, positioned around the vicinity of the meltable inserts, 225*a* and 225*b*. In this manner, heating is concentrated within and in the vicinity of the meltable inserts, 225*a* and 225*b*. Furthermore, the use of induction coils, 405*a* and 405*b*, as a heating element minimizes the possibility of fire. This is especially important when the present method is used to provide expandable tubular liners for oil and gas wellbores.

In an exemplary embodiment, the threaded connection 218 is sufficiently heated to melt at least a portion of the meltable inserts 225*a* and 225*b*. In an exemplary embodiment, the threaded connection 218 is heated to operating temperatures ranging from about 150 F to 1500 F for a time period of about 2-3 seconds to 2-3 minutes. In an exemplary embodiment, the melted portions of the meltable inserts, 225*a* and 225*b*, flow into at least a portion of the gap between the threads 210 and 220 of the threaded connection 218 by capillary action. In this manner, an optimal bond is formed between the first and second tubes, 205 and 215.

The melted portions of the meltable inserts, 225*a* and 225*b*, are then allowed to cool. In an exemplary embodiment, the melted portions of the meltable inserts, 225*a* and 225*b*, bond with and form a metallurgical alloy with the tubes 205 and 215. In this manner, the tubes 205 and 215 are preferably permanently bonded to one another. In this manner, the tubes 205 and 215 form a unitary tubular structure. In an exemplary embodiment, the material composition of the metallurgical bond between the tubes, 205 and 215, and the meltable inserts 225 includes aluminum, indium, bismuth, cadmium, lead, tin, brass, and/or bronze, or one or more alloys thereof, in order to provide a metallurgical bond having optimum strength.

Figure 5:
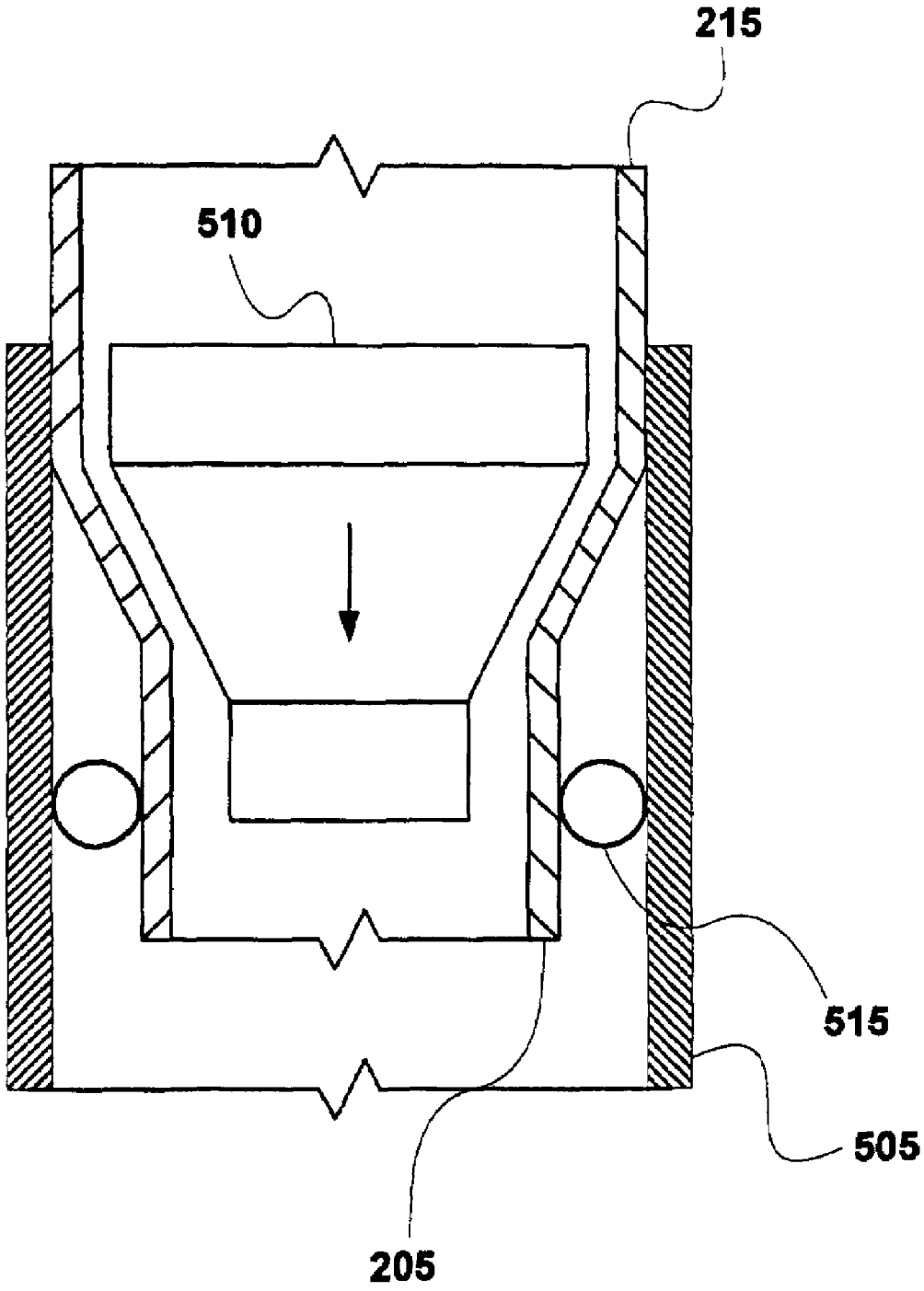
FIG. 5 is a partial cross-sectional illustration of an expansion cone radially expanding the tubes of FIG. 4 into contact with a preexisting structure.

As illustrated in FIG. 5, in steps 125 and 130, the tubes 205 and 215 are then positioned within a preexisting structure 505, and radially expanded into contact with the interior walls of the preexisting structure 505 using an expansion cone 510. The tubes 205 and 215 may be radially expanded into intimate contact with the interior walls of the preexisting structure 505, for example, by: (1) pushing or pulling the expansion cone 510 through the interior of the tubes 205 and 215; and/or (2) pressurizing the region within the tubes 205 and 215 behind the expansion cone 510 with a fluid. In an exemplary embodiment, one or more sealing members 515 are further provided on the outer surface of the tubes 205 and 215, in order to optimally seal the interface between the radially expanded tubes 205 and 215 and the interior walls of the preexisting structure 505.

In an exemplary embodiment, the radial expansion of the tubes 205 and 215 into contact with the interior walls of the preexisting structure 505, in steps 125 and 130, is performed substantially as disclosed in one or more of the following co-pending patent applications: (1) U.S. Pat. No. 6,328,113, which was filed as U.S. patent application Ser. No. 09/440,338, filed on Nov. 15, 1999, which claims priority from provisional application 60/108,558, filed on Nov. 16, 1998; (2) U.S. Pat. No. 6,497,289, which was filed as U.S. patent application Ser. No. 09/454,139, filed on Dec. 3, 1999, which claims priority from provisional application 60/111,293, filed on Dec. 7, 1998; (3) U.S. patent application Ser. No. 09/502,350, filed on Feb. 10, 2000, which claims priority from provisional application 60/119,611, filed on Feb. 11, 1999, (4) U.S. patent application Ser. No. 09/510,913, filed on Feb. 23, 2000, which claims priority from provisional application 60/121,702, filed on Feb. 25, 1999, (5) U.S. Pat. No. 6,568,471, which was filed as patent application Ser. No. 09/512,895, filed on Feb. 24, 2000, which claims priority from provisional application 60/121,841, filed on Feb. 26, 1999, (6) U.S. Pat. No. 6,575,240, which was filed as patent application Ser. No. 09/511,941, filed on Feb. 24, 2000, which claims priority from provisional application 60/121,907, filed on Feb. 26, 1999, (7) U.S. Pat. No. 6,640,903 which was filed as U.S. patent application Ser. No. 09/523,468, filed on Mar. 10, 2000, which claims priority from provisional application 60/124,042, filed on Mar. 11, 1999, (8) U.S. Pat. No. 6,604,763, which was filed as application Ser. No. 09/559,122, filed on Apr. 26, 2000, which claims priority from provisional application 60/131,106, filed on Apr. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. provisional patent application Ser. No. 60/143,039, filed on Jul. 9, 1999, (11) U.S. patent application Ser. No. 10/030,593, filed on Jan. 8, 2002, which claims priority from provisional application 60/146,203, filed on Jul. 29, 1999, Applicants incorporate by reference the disclosures of the above applications.

In several alternative embodiments, the radial expansion of the tubes 205 and 215 into contact with the interior walls of the preexisting structure 505, in steps 125 and 130, is performed using one or more of the conventional commercially available radial expansion devices and/or methods available from Baker Hughes, Weatherford, and/or Enventure Global Technology L.L.C.

In several alternative embodiments, the radial expansion of the tubes 205 and 215 into contact with the interior walls of the preexisting structure 505, in steps 125 and 130, is performed using conventional commercially available radial expansion devices and/or methods such as, for example, hydroforming and/or radial expansion using rotary expansion devices.

Figure 6:
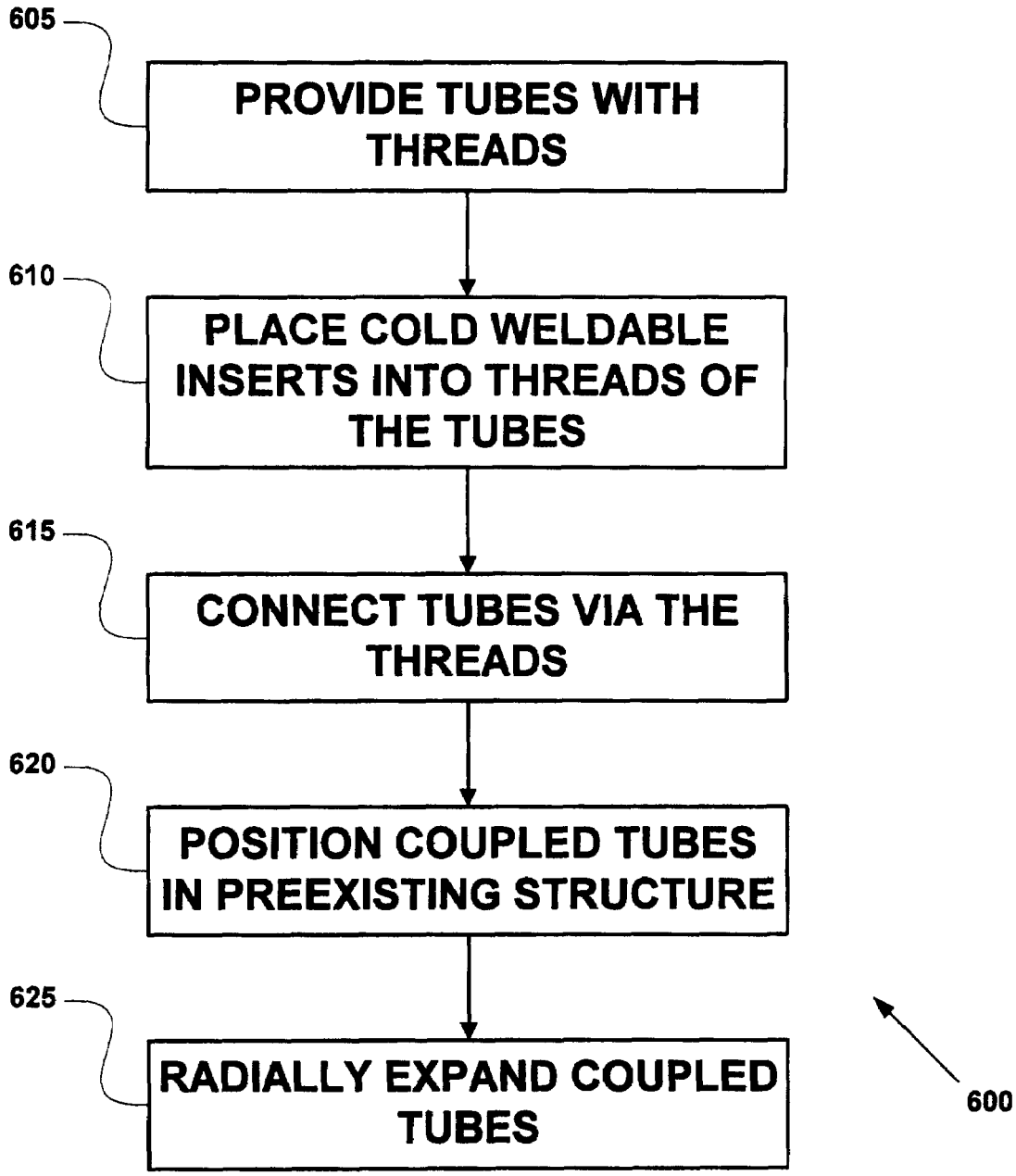
FIG. 6 is a flow chart illustrating an exemplary embodiment of a method for coupling a plurality of tubes to a preexisting structure.

Referring to FIG. 6, an exemplary embodiment of a method 600 for forming and/or repairing a wellbore casing, pipeline, or structural support includes the steps of: (1) providing first and second tubes having first and second threads in step 605; (2) positioning a cold weldable insert into the first and second threads of the first and second tubes in step 610; (3) coupling the first and second threads of the first and second tubes to form a threaded connection in step 615; (4) positioning the coupled first and second tubes within a pre-existing structure in step 620; and (5) radially expanding the coupled first and second tubes into contact with the preexisting structure in step 625.

Figure 7:
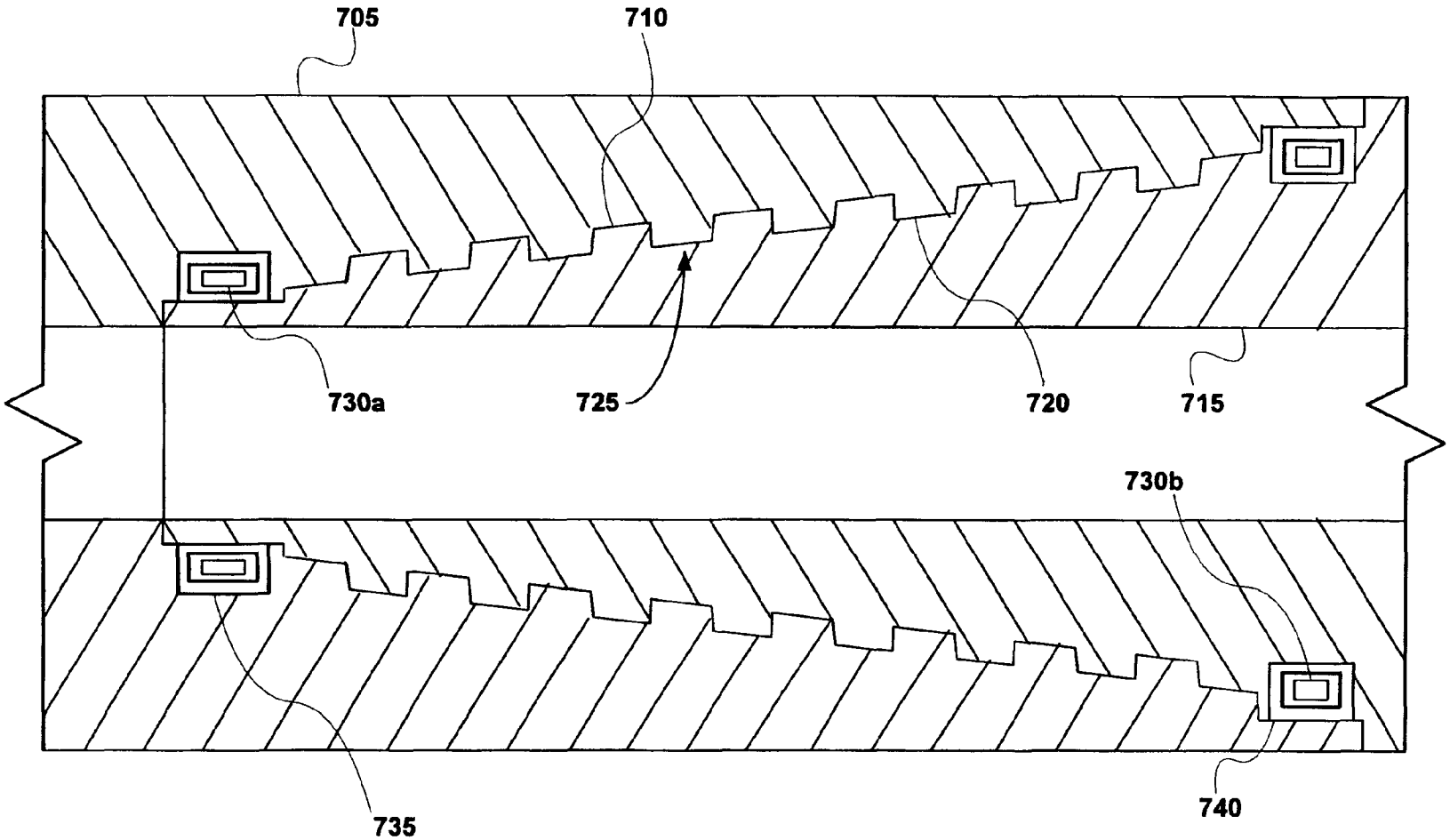
FIG. 7 is a cross-sectional illustration of an exemplary embodiment of the threaded connection between a pair of tubes, including cold weldable inserts.

As illustrated in FIG. 7, in steps 605, 610, and 615, a first tube 705 having first threads 710 is coupled to a second tube 715 having second threads 720. Once coupled, the tubes 705 and 715 form a threaded connection 725. The tubes 705 and 715 may comprise any number of conventional tubes. In an exemplary embodiment, the tubes 705 and 715 are oilfield country tubular goods or wellbore casings available from Lone Star Steel.

A first cold-weldable insert 730*a* is preferably positioned within a first channel 735 provided in the first threads 710, and a second cold-weldable insert 730*b* is preferably positioned within a second channel 740 provided in the second threads 720. The threads 710 and 720 may include any number of conventional commercially available threads. In an exemplary embodiment, the first and second threads, 710 and 720, are pin and box threads available from Grant Prideco. The channels 230 and 240 may be provided within any portion of the threads 710 and 720. In an exemplary embodiment, the channels 735 and 740 are provided adjacent to the end portions of the threads 710 and 720, in order to optimally position the cold-weldable inserts, 730*a* and 730*b*.

Figure 8:
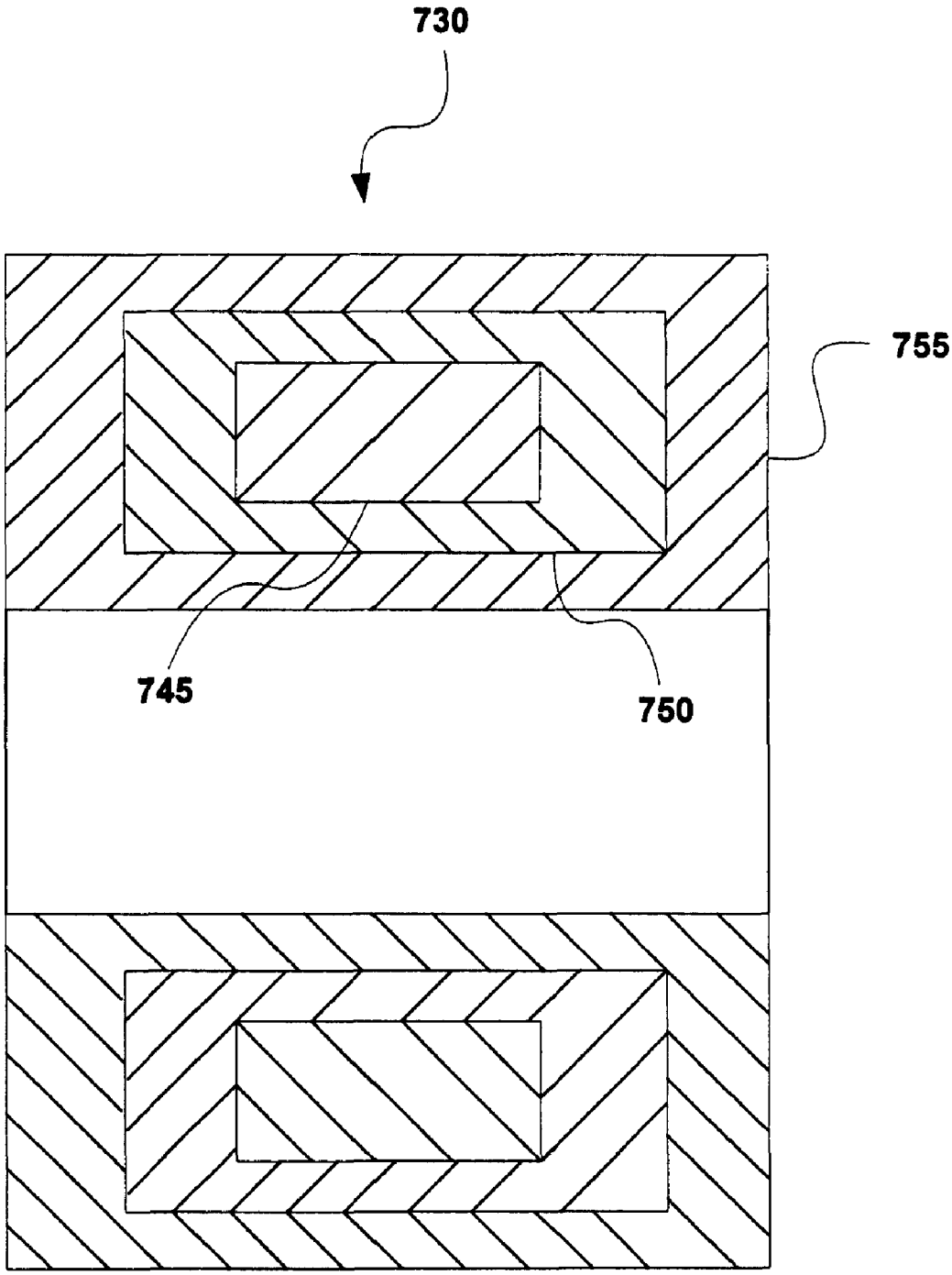
FIG. 8 is a cross-sectional illustration of an exemplary embodiment of the cold weldable inserts of FIG. 7.

The cold-weldable inserts 730 may include any number of conventional commercially available cold-weldable inserts, and/or materials, capable of forming a metallurgical bond with at least one of the tubes 705 and/or 715, or permitting a metallurgical bond to be formed between the tubes, when energy is input into region proximate or constituting the cold-weldable inserts during, for example, the subsequent radial expansion and plastic deformation of the tubes 705 and 715. In an exemplary embodiment, as illustrated in FIG. 8, the cold-weldable inserts 730 include an inner core 745, a layer of a cold-weldable material 750, and an outermost layer of a flux 755. In an exemplary embodiment, the inner core 745 is fabricated from indium, aluminum, bismuth, indium, cadmium, lead, tin, brass, and/or bronze, or alloys thereof, the layer of cold-weldable material 750 is fabricated from indium, aluminum, bismuth, indium, cadmium, lead, tin, brass, and/or bronze, or alloys thereof, and the flux 755 is fabricated from, or includes, ammonium cetyl sulfate, saturated zinc chloride in hydrochloric aside, and/or Amasan flux C66, or 157 flux. In an exemplary embodiment, the cold-weldable inserts 730 are ring shaped. In an exemplary embodiment, one or more of the inserts 730 include, or constitute, one or more of the BrazeCoat™, S-Bond™, and/or WideGap™ insert materials and products available from Material Resources International in Lansdale, Pa. and described, for example, at the following website: http://www.materialsresources.com.

In an exemplary embodiment, one or more of the cold-weldable inserts 730 include, or constitute, a Trib-Gel chemical cold welding agent. Trib-Gel is a chemical agent that permits a cold welded metallurgical joint and/or a Trib-Joint to be formed between tubular parts such as, for example, overlapping tubular members that are radially expanded and plastically deformed together by increasing the friction between the mating surfaces of the overlapping tubular members thereby inducing localized heating of the overlapping portions of the tubular members.

In an exemplary embodiment, the Trib-Gel is provided and operates substantially as described in TRIB-GEL, A CHEMI- CAL COLD WELDING AGENT, G. R. Linzell, Technical Paper presented at: International Symposium on Exploiting Solid State Joining, TWI, Great Abington, Cambridge, U.K., 14, Sep. 1999, the disclosure of which is incorporated herein by reference. In an exemplary embodiment, the Trib-Gel includes, or is, one or more of the conventional commercially available Trib-Gel products available from TribTech™ and described at the website: www.tribtech.com/products.htm.

Figure 9:
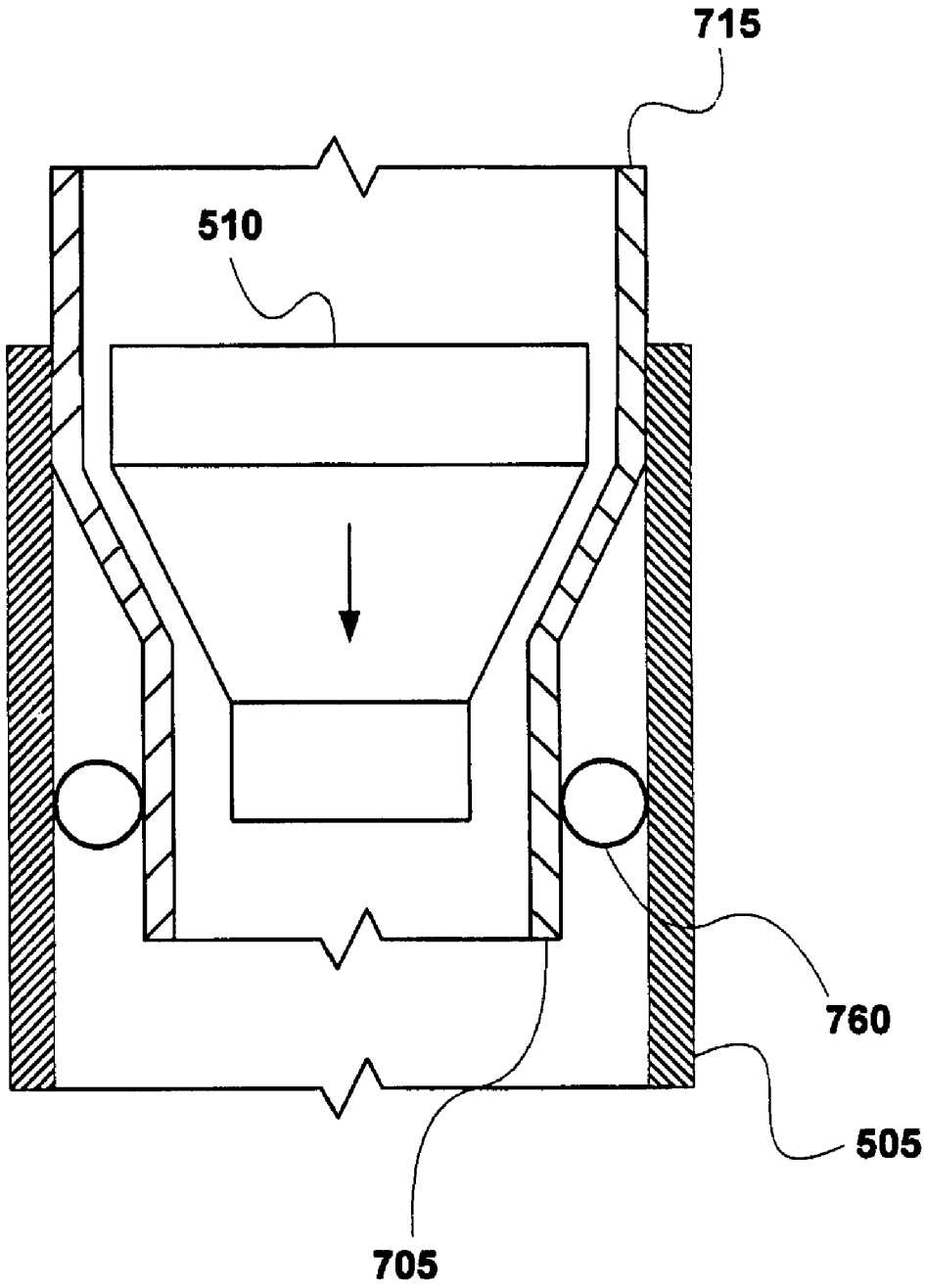
FIG. 9 is a partial cross-sectional illustration of an expansion cone radially expanding the tubes of FIG. 8 into contact with a preexisting structure.

As illustrated in FIG. 9, in an exemplary embodiment, in steps 620 and 625, the tubes 705 and 715 are then positioned within a preexisting structure 505, and radially expanded into contact with the interior walls of the preexisting structure 505 using an expansion cone 510. The tubes 705 and 715 may be radially expanded into intimate contact with the interior walls of the preexisting structure 505, for example, by: (1) pushing or pulling the expansion cone 510 through the interior of the tubes 705 and 715; and/or (2) pressurizing the region within the tubes 705 and 715 behind the expansion cone 510 with a fluid. In an exemplary embodiment, one or more sealing members 760 are further provided on the outer surface of the tubes 705 and 715, in order to optimally seal the interface between the radially expanded tubes 705 and 715 and the interior walls of the preexisting structure 505. In an exemplary embodiment, the energy input into the cold-weldable inserts 730 during the radial expansion and plastic deformation of the tubes 705 and 715 is sufficient to cause the cold-weldable inserts 730 to form a metallurgical bond with the tubes 705 and/or 715 and/or permit a metallurgical bond to be formed between the tubes.

In an exemplary embodiment, the radial expansion of the tubes 705 and 715 into contact with the interior walls of the preexisting structure 505, in steps 620 and 625, is performed substantially as disclosed in one or more of the following co-pending patent applications: (1) U.S. Pat. No. 6,328,113, which was filed as U.S. patent application Ser. No. 09/440,338, filed on Nov. 15, 1999, which claims priority from provisional application 60/108,558, filed on Nov. 16, 1998; (2) U.S. Pat. No. 6,497,289, which was filed as U.S. patent application Ser. No. 09/454,139, filed on Dec. 3, 1999, which claims priority from provisional application 60/111,293, filed on Dec. 7, 1998; (3) U.S. patent application Ser. No. 09/502,350, filed on Feb. 10, 2000, which claims priority from provisional application 60/119,611, filed on Feb. 11, 1999, (4) U.S. patent application Ser. No. 09/510,913, filed on Feb. 23, 2000, which claims priority from provisional application 60/121,702, filed on Feb. 25, 1999, (5) U.S. Pat. No. 6,568,471, which was filed as patent application Ser. No. 09/512,895, filed on Feb. 24, 2000, which claims priority from provisional application 60/121,841, filed on Feb. 26, 1999, (6) U.S. Pat. No. 6,575,240, which was filed as patent application Ser. No. 09/511,941, filed on Feb. 24, 2000, which claims priority from provisional application 60/121,907, filed on Feb. 26, 1999, (7) U.S. Pat. No. 6,640,903 which was filed as U.S. patent application Ser. No. 09/523,468, filed on Mar. 10, 2000, which claims priority from provisional application 60/124,042, filed on Mar. 11, 1999, (8) U.S. Pat. No. 6,604,763, which was filed as application Ser. No. 09/559,122, filed on Apr. 26, 2000, which claims priority from provisional application 60/131,106, filed on Apr. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. provisional patent application Ser. No. 60/143,039, filed on Jul. 9, 1999, (11) U.S. patent application Ser. No. 10/030,593, filed on Jan. 8, 2002, which claims priority from provisional application 60/146,203, filed on Jul. 29, 1999, Applicants incorporate by reference the disclosures of the above applications.

In several alternative embodiments, the radial expansion of the tubes 705 and 715 into contact with the interior walls of the preexisting structure 505, in steps 620 and 625, is performed using one or more of the conventional commercially available radial expansion devices and/or methods available from Baker Hughes, Weatherford, and/or Enventure Global Technology L.L.C.

In several alternative embodiments, the radial expansion of the tubes 705 and 715 into contact with the interior walls of the preexisting structure 505, in steps 620 and 625, is performed using conventional commercially available radial expansion devices and/or methods such as, for example, hydroforming and/or radial expansion using rotary expansion devices.

Figure 10:
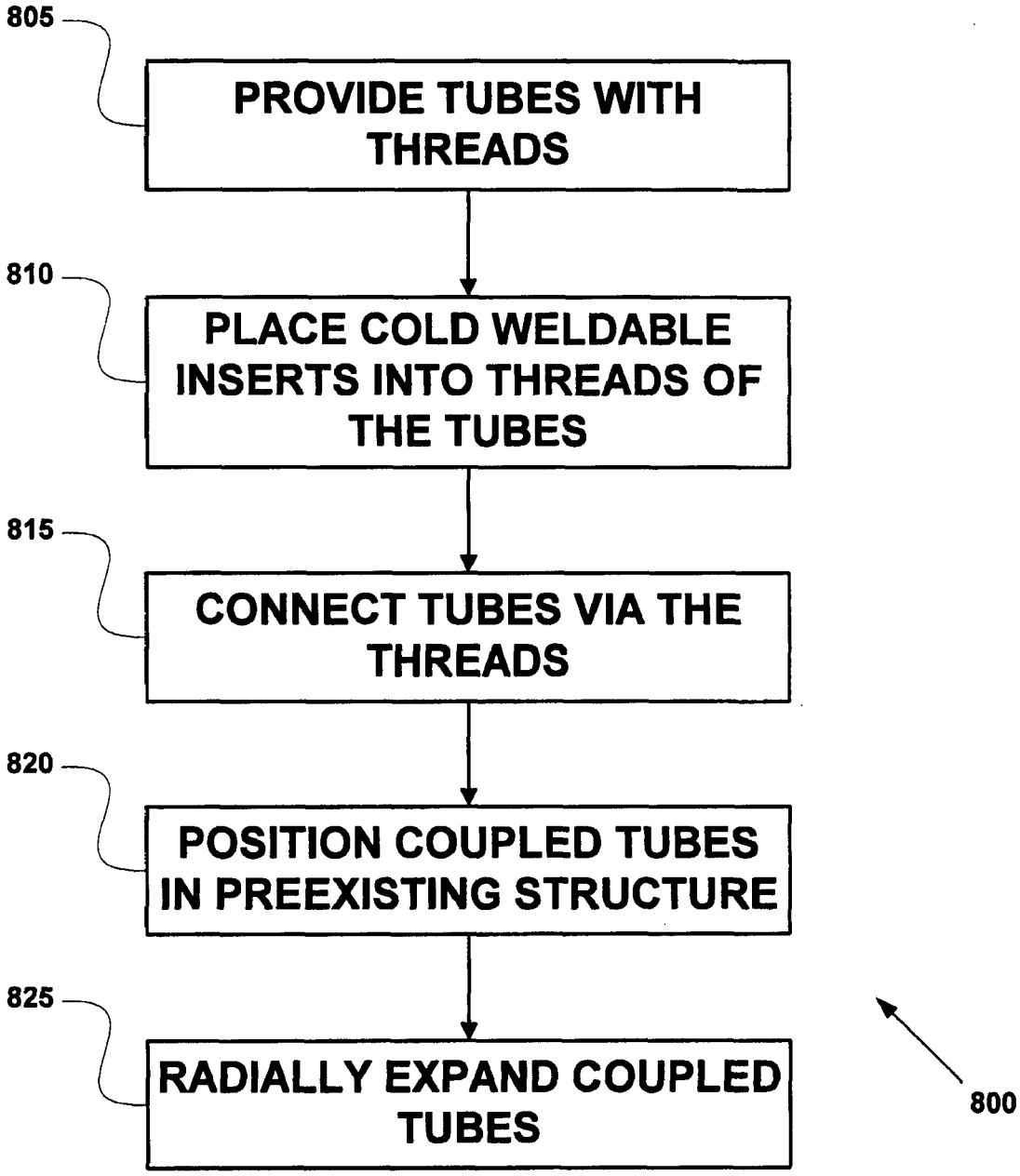
FIG. 10 is a flow chart illustrating an exemplary embodiment of a method for coupling a plurality of tubes to a preexisting structure.

Referring to FIG. 10, an exemplary embodiment of a method 800 for forming and/or repairing a wellbore casing, pipeline, or structural support includes the steps of: (1) providing first and second tubes having first and second threads in step 805; (2) positioning a cold weldable insert into the first and second threads of the first and second tubes in step 810; (3) coupling the first and second threads of the first and second tubes to form a threaded connection in step 815; (4) positioning the coupled first and second tubes within a preexisting structure in step 820; and (5) radially expanding the coupled first and second tubes into contact with the preexisting structure in step 825.

Figure 11:
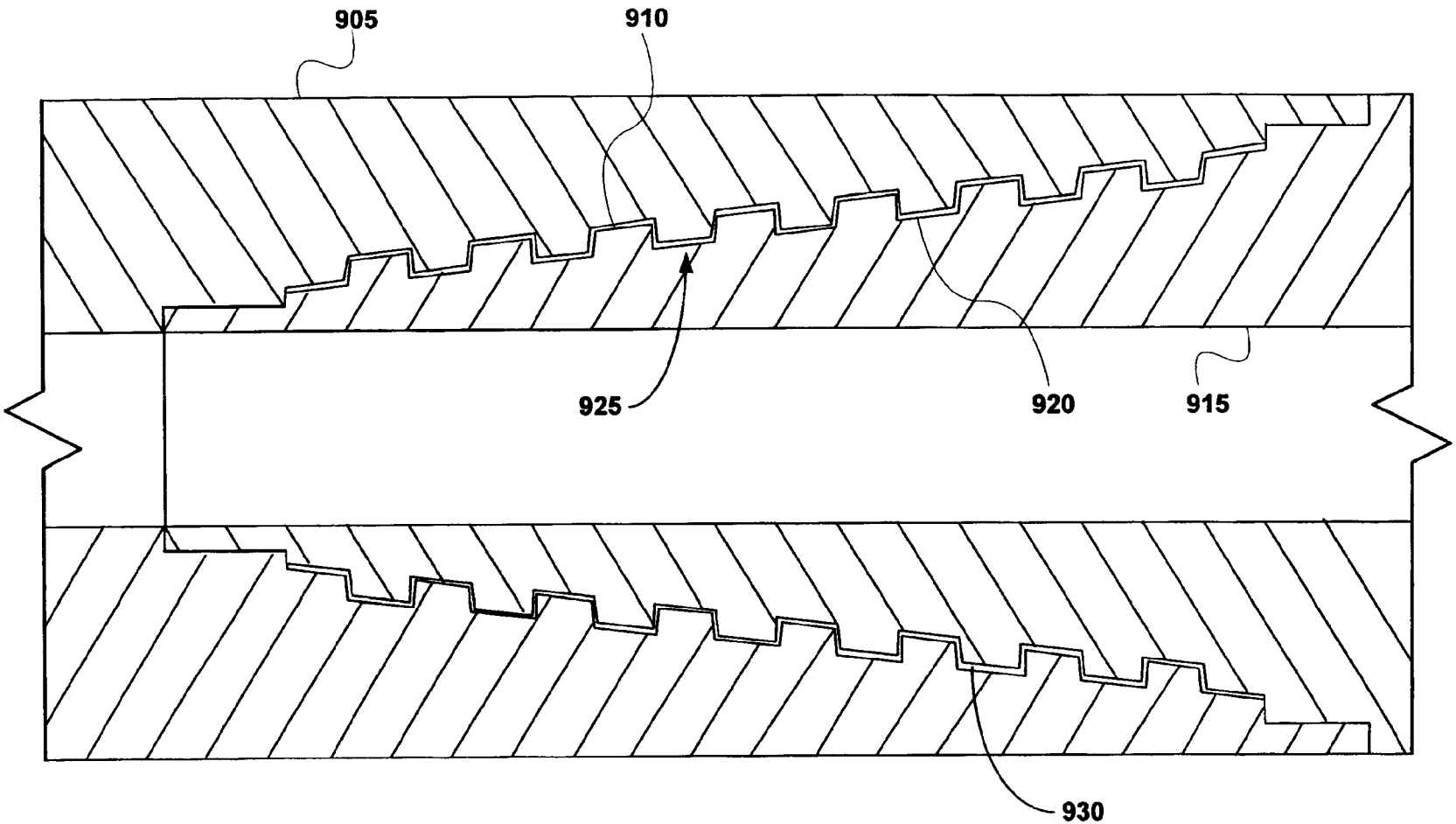
FIG. 11 is a cross-sectional illustration of an exemplary embodiment of the threaded connection between a pair of tubes, including cold weldable inserts.

As illustrated in FIG. 11, in steps 805, 810, and 815, a first tube 905 having first threads 910 is coupled to a second tube 915 having second threads 920. Once coupled, the tubes 905 and 915 form a threaded connection 925. The tubes 905 and 915 may comprise any number of conventional tubes. In an exemplary embodiment, the tubes 905 and 915 are oilfield country tubular goods or wellbore casings available from Lone Star Steel.

In an exemplary embodiment, the cold-weldable insert 730 is positioned within the threaded connection 925 between at least a portion of the threads 910 and 920 of the first and second tubes, 905 and 915, respectively. The threads 910 and 920 may include any number of conventional commercially available threads. In an exemplary embodiment, the first and second threads, 910 and 920, are pin and box threads available from Grant Prideco.

Figure 12:
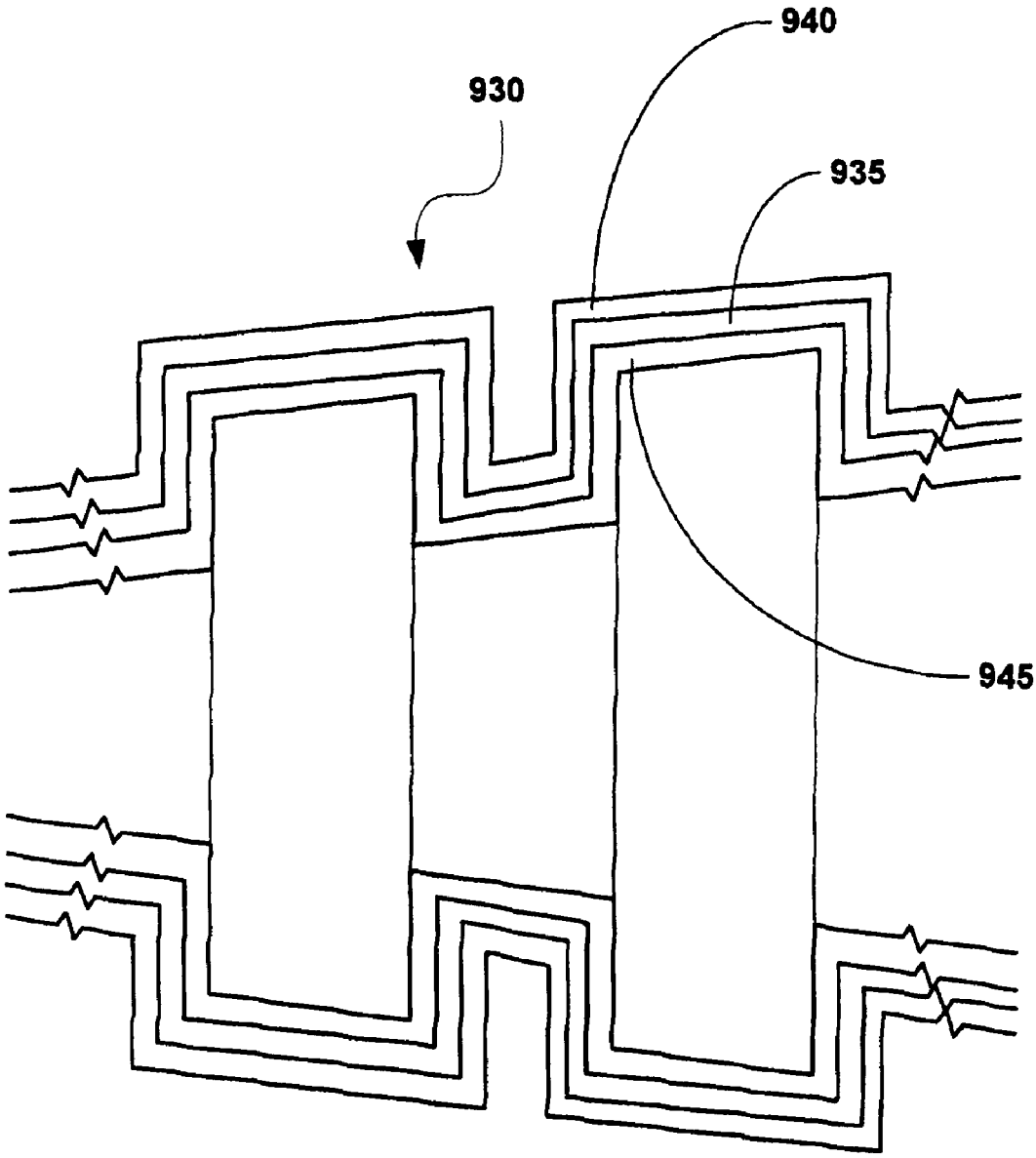
FIG. 12 is a cross-sectional illustration of an exemplary embodiment of the cold weldable inserts of FIG. 11.

The cold-weldable inserts 930 may include any number of conventional commercially available cold-weldable inserts, and/or materials, capable of forming a metallurgical bond with at least one of the tubes 905 and/or 915, or permitting a metallurgical bond to be formed between the tubes, when energy is input into region proximate or constituting the cold-weldable inserts during, for example, the subsequent radial expansion and plastic deformation of the tubes 905 and 915. In an exemplary embodiment, as illustrated in FIG. 12, the cold-weldable inserts 930 include an inner core 935 including a cold weldable material 935, and outer layers, 940 and 945 of a flux. In an exemplary embodiment, the inner core 935 is fabricated from indium, aluminum, bismuth, cadmium, lead, tin, brass, and/or bronze, and/or alloys thereof, and the outer layers, 940 and 945, are fabricated from aluminum, indium, aluminum, bismuth, cadmium, lead, tin, brass, and/or bronze, and/or alloys thereof. In an exemplary embodiment, the cold-weldable inserts 930 are tapered tubular members that include preformed threads.

In an exemplary embodiment, one or more of the inserts 930 include, or constitute, one or more of the BrazeCoat™, S-Bond™, and/or WideGap™ insert materials and products available from Material Resources International in Lansdale, Pa. and described, for example, at the following website: http://www.materialsresources.com.

In an exemplary embodiment, one or more of the cold-weldable inserts 930 include or constitute a Trib-Gel chemical cold welding agent. Trib-Gel is a chemical agent that permits a cold welded metallurgical joint and/or a Trib-Joint to be formed between tubular parts such as, for example, overlapping tubular members that are radially expanded and plastically deformed together by increasing the friction between the mating surfaces of the overlapping tubular members thereby inducing localized heating of the overlapping portions of the tubular members. In an exemplary embodiment, the Trib-Gel is provided and operates substantially as described in TRIB-GEL, A CHEMICAL COLD WELDING AGENT, G. R. Linzell, Technical Paper presented at: International Symposium on Exploiting Solid State Joining, TWI, Great Abington, Cambridge, U.K., 14, Sep. 1999, the disclosure of which is incorporated herein by reference. In an exemplary embodiment, the Trib-Gel includes or is one or more of the conventional commercially available Trib-Gel products available from TribTech™ and described at the website: www.tribtech.com/products.htm.

Figure 13:
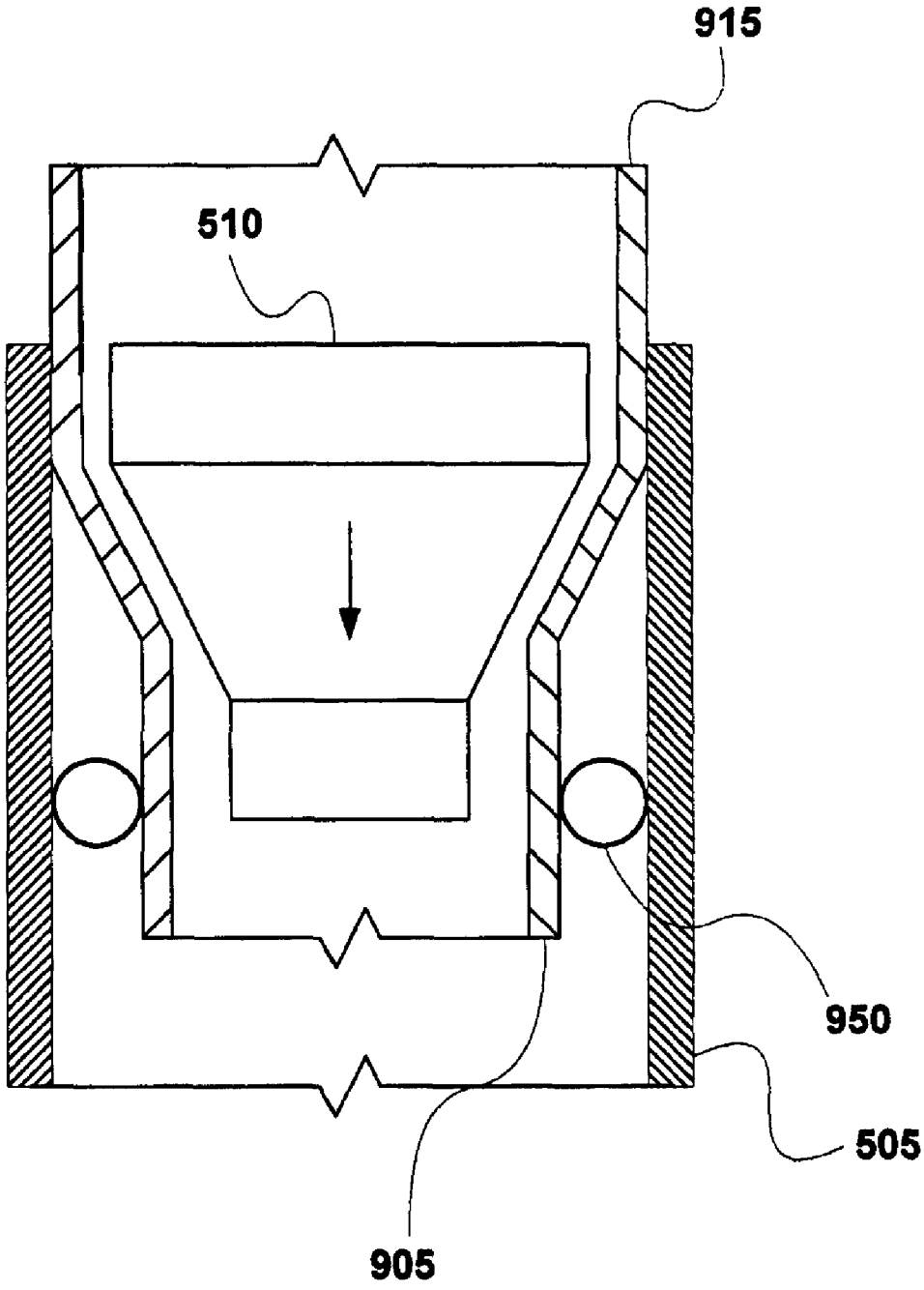
FIG. 13 is a partial cross-sectional illustration of an expansion cone radially expanding the tubes of FIG. 11 into contact with a preexisting structure.

As illustrated in FIG. 13, in an exemplary embodiment, in steps 820 and 825, the tubes 905 and 915 are then positioned within a preexisting structure 505, and radially expanded into contact with the interior walls of the preexisting structure 505 using an expansion cone 510. The tubes 905 and 915 may be radially expanded into intimate contact with the interior walls of the preexisting structure 505, for example, by: (1) pushing or pulling the expansion cone 510 through the interior of the tubes 905 and 915; and/or (2) pressurizing the region within the tubes 905 and 915 behind the expansion cone 510 with a fluid. In an exemplary embodiment, one or more sealing members 950 are further provided on the outer surface of the tubes 905 and 915, in order to optimally seal the interface between the radially expanded tubes 905 and 915 and the interior walls of the preexisting structure 505. In an exemplary embodiment, the energy input into the cold-weldable inserts 930 during the radial expansion and plastic deformation of the tubes 905 and 915 is sufficient to cause the cold-weldable inserts 930 to form a metallurgical bond with the tubes 905 and/or 915 and/or permit a metallurgical bond to be formed between the tubes.

In an exemplary embodiment, the radial expansion of the tubes 905 and 915 into contact with the interior walls of the preexisting structure 505, in steps 820 and 825, is performed substantially as disclosed in one or more of the following co-pending patent applications: (1) U.S. Pat. No. 6,328,113, which was filed as U.S. patent application Ser. No. 09/440,338, filed on Nov. 15, 1999, which claims priority from provisional application 60/108,558, filed on Nov. 16, 1998; (2) U.S. Pat. No. 6,497,289, which was filed as U.S. patent application Ser. No. 09/454,139, filed on Dec. 3, 1999, which claims priority from provisional application 60/111,293, filed on Dec. 7, 1998; (3) U.S. patent application Ser. No. 09/502,350, filed on Feb. 10, 2000, which claims priority from provisional application 60/119,611, filed on Feb. 11, 1999, (4) U.S. patent application Ser. No. 09/510,913, filed on Feb. 23, 2000, which claims priority from provisional application 60/121,702, filed on Feb. 25, 1999, (5) U.S. Pat. No. 6,568,471, which was filed as patent application Ser. No. 09/512,895, filed on Feb. 24, 2000, which claims priority from provisional application 60/121,841, filed on Feb. 26, 1999, (6) U.S. Pat. No. 6,575,240, which was filed as patent application Ser. No. 09/511,941, filed on Feb. 24, 2000, which claims priority from provisional application 60/121,907, filed on Feb. 26, 1999, (7) U.S. Pat. No. 6,640,903 which was filed as U.S. patent application Ser. No. 09/523,468, filed on Mar. 10, 2000, which claims priority from provisional application 60/124,042, filed on Mar. 11, 1999, (8) U.S. Pat. No. 6,604,763, which was filed as application Ser. No. 09/559,122, filed on Apr. 26, 2000, which claims priority from provisional application 60/131,106, filed on Apr. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. provisional patent application Ser. No. 60/143,039, filed on Jul. 9, 1999, (11) U.S. patent application Ser. No. 10/030,593, filed on Jan. 8, 2002, which claims priority from provisional application 60/146,203, filed on Jul. 29, 1999, Applicants incorporate by reference the disclosures of the above applications.

In several alternative embodiments, the radial expansion of the tubes 905 and 915 into contact with the interior walls of the preexisting structure 505, in steps 820 and 825, is performed using one or more of the conventional commercially available radial expansion devices and/or methods available from Baker Hughes, Weatherford, and/or Enventure Global Technology L.L.C.

In several alternative embodiments, the radial expansion of the tubes 905 and 915 into contact with the interior walls of the preexisting structure 505, in steps 820 and 825, is performed using conventional commercially available radial expansion devices and/or methods such as, for example, hydroforming and/or radial expansion using rotary expansion devices.

In an exemplary embodiment, the injection of energy into the cold-weldable inserts 703 and/or 930 also lower the melting point of at least a portion of the cold-weldable inserts such that the cold-weldable inserts can be melted using less injected thermal energy thereby facilitating the formation of a metallurgical bond between the cold-weldable inserts and at least one of the overlapping tubulars, 705 and 715, and/or 905 and 915, upon the combined injection of energy, of any kind, combined with the injection of thermal energy into the cold-weldable inserts.

In an exemplary embodiment, as described above, the cold-weldable inserts 730 and/or 930 that include, or constitute, a Trib-Gel chemical cold welding agent provide a cold welded metallurgical joint of the overlapping tubulars, 705 and 715, and/or 905 and 915, respectively, during the radial expansion and plastic deformation of the overlapping tubulars. In several alternative embodiments, the cold-weldable inserts 730 and/or 930 that include, or constitute, a Trib-Gel chemical cold welding agent provide a cold welded metallurgical joint of the overlapping tubulars, 705 and 715, and/or 905 and 915, respectively, during the injection of energy such as, for example, mechanical, acoustic, vibrational, electrical, electro-magnetic, and/or thermal energy into the overlapping tubulars prior to, during, and/or after the radial expansion and plastic deformation of the overlapping tubulars.

In several exemplary embodiments, one or more of the inserts 225, 730, or 930 are formed within, or proximate, one or more of the threaded connections 218, 725, or 925 using a conventional kinetic metallization method in order to provide a reliable method of providing the insert materials on the tubes. In an exemplary embodiment, the kinetic metallization method is provided using one or more of the conventional commercially available products available from Inovati, Inc. in Santa Barbara, Calif., U.S.A.

In several exemplary embodiments, one or more of the inserts 225, 730, or 930 include, or constitute, one or more of the BrazeCoat™, S-Bond™, and/or WideGap™ insert materials and products available from Material Resources International in Lansdale, Pa. and described, for example, at the following website: http://www.materialsresources.com.

In several exemplary embodiments, one or more of the inserts 225, 730, or 930 include, or constitute, one or more of the insert materials and products available from Spur Industries in Spokane, Wash., U.S.A., and described, for example, at the following website: http://www.spurind.com.

A method of radially expanding and plastically deforming a first tube having first threads, and a second tube having second threads has been described that includes coupling a first insert to the first threads, coupling the first threads to the second threads to form a threaded connection, heating the threaded connection sufficiently to melt at least a portion of the first insert, allowing the melted portion of the first insert to flow and solidify within the threaded connection, and radially expanding and plastically deforming the coupled first and second tubes. In an exemplary embodiment, coupling the first insert to the first threads includes placing the first insert within a portion of the first threads. In an exemplary embodiment, the first insert includes an outer layer of flux. In an exemplary embodiment, the first insert comprises an inner core comprised of a first material, and an outer layer comprised of a second material, and wherein the first material has a higher melting point than the second material. In an exemplary embodiment, the outer layer of the second material comprises an outer layer of flux. In an exemplary embodiment, the first material is selected from the group consisting of aluminum, indium, bismuth, cadmium, lead, tin, brass, and bronze; and wherein the second material is selected from the group consisting of aluminum, indium, bismuth, cadmium, lead, tin, brass, and bronze. In an exemplary embodiment, the first insert is fabricated from materials selected from the group consisting of aluminum, indium, bismuth, cadmium, lead, tin, brass, and bronze. In an exemplary embodiment, the method further includes applying a flux to the first and second threads of the first and second tubes. In an exemplary embodiment, the first insert is a ring. In an exemplary embodiment, the method further includes placing the coupled first and second tubes within a preexisting structure before radially expanding and plastically deforming the coupled first and second tubes. In an exemplary embodiment, the preexisting structure is a wellbore casing. In an exemplary embodiment, the preexisting structure is a pipeline. In an exemplary embodiment, the preexisting structure is a structural support. In an exemplary embodiment, the method further includes, after coupling a first insert to the first threads, coupling a second insert to the second threads.

An expandable tubular liner has also been described that includes a first tube having first threads, and a second tube having second threads coupled to the first threads; wherein the first threads are coupled to the second threads by the process of: coupling a first insert to the first threads, coupling the first threads to the second threads, heating the first insert sufficiently to melt at least a portion of the first insert, and cooling the melted portion of the first insert. In an exemplary embodiment, coupling the first insert to the first threads comprises placing the first insert within a portion of the first threads. In an exemplary embodiment, the first insert includes an outer layer of flux. In an exemplary embodiment, the first insert includes an inner core composed of a first material, and an outer layer composed of a second material, and wherein the first material has a higher melting point than the second material. In an exemplary embodiment, the outer layer of the second material includes an outer layer of flux. In an exemplary embodiment, the first material is selected from the group consisting of aluminum, indium, bismuth, cadmium, lead, tin, brass, and bronze; and the second material is selected from the group consisting of aluminum, indium, bismuth, cadmium, lead, tin, brass, and bronze. In an exemplary embodiment, the first insert is fabricated from materials selected from the group consisting of aluminum, indium, bismuth, cadmium, lead, tin, brass, and bronze. In an exemplary embodiment, the liner further includes applying a flux to the first and second threads. In an exemplary embodiment, the first insert is a ring. In an exemplary embodiment, the liner further includes, after coupling a first insert to the first threads, coupling a second insert to the second threads.

An apparatus has also been described that includes a preexisting structure coupled to a tubular liner, the tubular liner comprising a first tube including first threads, and a second tube including second threads, wherein the tubular liner is coupled to the preexisting structure by the process of: coupling a first insert to the first threads, coupling the first threads to the second threads to form a threaded connection, heating the threaded connection sufficiently to melt at least a portion of the first insert, allowing the melted portion of the first insert to flow and solidify within the threaded connection, positioning the coupled first and second tubes within a preexisting structure, and radially expanding the coupled first and second tubes into contact with the preexisting structure. In an exemplary embodiment, coupling the first insert to the first threads includes placing the first insert within a portion of the first threads. In an exemplary embodiment, the first insert includes an outer layer of flux. In an exemplary embodiment, the first insert includes an inner core composed of a first material, and an outer layer composed of a second material, and wherein the first material has a higher melting point than the second material. In an exemplary embodiment, the outer layer of the second material includes an outer layer of flux. In an exemplary embodiment, the first material is selected from the group consisting of aluminum, indium, bismuth, cadmium, lead, tin, brass, and bronze; and wherein the second material is selected from the group consisting of aluminum, indium, bismuth, cadmium, lead, tin, brass, and bronze. In an exemplary embodiment, the first insert is fabricated from materials selected from the group consisting of aluminum, indium, bismuth, cadmium, lead, tin, brass, and bronze. In an exemplary embodiment, the apparatus further includes applying a flux to the first and second threads. In an exemplary embodiment, the first insert is a ring. In an exemplary embodiment, the preexisting structure is a wellbore casing. In an exemplary embodiment, the preexisting structure is a pipeline. In an exemplary embodiment, the preexisting structure is a structural support. In an exemplary embodiment, the apparatus further includes, after the step of coupling a first insert to the first threads, the step of coupling a second insert to the second threads.

A method of radially expanding and plastically deforming a first tube having first threads, and a second tube having second threads has been described that includes coupling a first insert to the first threads, coupling the first threads to the second threads to form a threaded connection, and radially expanding and plastically deforming the coupled first and second tubes and forming a metallurgical bond between the first insert and at least one of the first and second tubes. In an exemplary embodiment, coupling the first insert to the first threads includes placing the first insert within a portion of the first threads. In an exemplary embodiment, the first insert includes an outer layer of flux. In an exemplary embodiment, the first insert includes an inner core composed of a first material, and an outer layer composed of a second material, and wherein the first material has a higher energy point at which an energy input will cause a metallurgical reaction than the second material. In an exemplary embodiment, the outer layer of the second material includes an outer layer of flux. In an exemplary embodiment, the first material is selected from the group consisting of aluminum, indium, bismuth, cadmium, lead, tin, brass, and bronze; and wherein the second material is selected from the group consisting of aluminum, indium, bismuth, cadmium, lead, tin, brass, and bronze. In an exemplary embodiment, the first insert is fabricated from materials selected from the group consisting of aluminum, indium, bismuth, cadmium, lead, tin, brass, and bronze. In an exemplary embodiment, the method further includes applying a flux to the first and second threads of the first and second tubes. In an exemplary embodiment, the first insert is a ring. In an exemplary embodiment, the method further includes placing the coupled first and second tubes within a preexisting structure before radially expanding and plastically deforming the coupled first and second tubes. In an exemplary embodiment, the preexisting structure is a wellbore casing. In an exemplary embodiment, the preexisting structure is a pipeline. In an exemplary embodiment, the preexisting structure is a structural support. In an exemplary embodiment, the method further includes, after coupling a first insert to the first threads, coupling a second insert to the second threads.

An expandable tubular liner has been described that includes a first tube having first threads, and a second tube having second threads coupled to the first threads; wherein the first threads are metallurgically bonded to the second threads by the process of: coupling a first insert to the first threads, coupling the first threads to the second threads, and radially expanding and plastically deforming the coupled first and second tubes. In an exemplary embodiment, coupling the first insert to the first threads includes placing the first insert within a portion of the first threads. In an exemplary embodiment, the first insert includes an outer layer of flux. In an exemplary embodiment, the first insert includes an inner core composed of a first material, and an outer layer composed of a second material, and wherein the first material has a higher energy point at which an energy input will cause a metallurgical reaction than the second material. In an exemplary embodiment, the outer layer of the second material includes an outer layer of flux. In an exemplary embodiment, the first material is selected from the group consisting of aluminum, indium, bismuth, cadmium, lead, tin, brass, and bronze; and wherein the second material is selected from the group consisting of aluminum, indium, bismuth, cadmium, lead, tin, brass, and bronze. In an exemplary embodiment, the first insert is fabricated from materials selected from the group consisting of aluminum, indium, bismuth, cadmium, lead, tin, brass, and bronze. In an exemplary embodiment, the liner further includes applying a flux to the first and second threads. In an exemplary embodiment, the first insert is a ring. In an exemplary embodiment, the liner further includes, after coupling a first insert to the first threads, coupling a second insert to the second threads.

An apparatus has been described that includes a preexisting structure coupled to a tubular liner, the tubular liner comprising a first tube including first threads, and a second tube including second threads, wherein the tubular liner is coupled to the preexisting structure by the process of: coupling a first insert to the first threads, coupling the first threads to the second threads to form a threaded connection, and radially expanding the coupled first and second tubes into contact with the preexisting structure and forming a metallurgical bond between the first insert and at least one of the first and second tubes. In an exemplary embodiment, coupling the first insert to the first threads includes placing the first insert within a portion of the first threads. In an exemplary embodiment, the first insert includes an outer layer of flux. In an exemplary embodiment, the first insert includes an inner core composed of a first material, and an outer layer composed of a second material, and wherein the first material has a higher energy point at which an energy input will cause a metallurgical reaction than the second material. In an exemplary embodiment, the outer layer of the second material includes an outer layer of flux. In an exemplary embodiment, the first material is selected from the group consisting of aluminum, indium, bismuth, cadmium, lead, tin, brass, and bronze; and wherein the second material is selected from the group consisting of aluminum, indium, bismuth, cadmium, lead, tin, brass, and bronze. In an exemplary embodiment, the first insert is fabricated from materials selected from the group consisting of aluminum, indium, bismuth, cadmium, lead, tin, brass, and bronze. In an exemplary embodiment, the apparatus further includes applying a flux to the first and second threads. In an exemplary embodiment, the first insert is a ring. In an exemplary embodiment, the preexisting structure is a wellbore casing. In an exemplary embodiment, the preexisting structure is a pipeline. In an exemplary embodiment, the preexisting structure is a structural support. In an exemplary embodiment, the apparatus further includes, after the step of coupling a first insert to the first threads, the step of coupling a second insert to the second threads.

A method of radially expanding and plastically deforming a first tube, a second tube, and a mechanical connection for coupling the first and second tubes, has been described that includes coupling an insert to at least one of the first and second tubes, coupling the first and second tubes together using the mechanical connection, radially expanding and plastically deforming the coupled first and second tubes, and forming a metallurgical bond between the insert and at least one of the first and second tubes by injecting energy into the insert prior to or during the radial expansion and plastic deformation of the first and second tubes. In an exemplary embodiment, the injected energy includes thermal energy. In an exemplary embodiment, the injected energy includes mechanical energy. In an exemplary embodiment, the injected energy includes electrical energy. In an exemplary embodiment, the injected energy includes magnetic energy. In an exemplary embodiment, the injected energy includes electromagnetic energy. In an exemplary embodiment, the injected energy includes acoustic energy. In an exemplary embodiment, the injected energy includes vibrational energy.

A method of radially expanding and plastically deforming a first tube, a second tube, and a mechanical connection for coupling the first and second tubes has been described that includes coupling an insert to at least one of the first and second tubes, coupling the first and second tubes together using the mechanical connection, radially expanding and plastically deforming the coupled first and second tubes, and forming a metallurgical bond between the insert and at least one of the first and second tubes by injecting energy into the insert prior to and during the radial expansion and plastic deformation of the first and second tubes. In an exemplary embodiment, the injected energy includes thermal and mechanical energy. In an exemplary embodiment, the injected energy includes thermal and electrical energy. In an exemplary embodiment, the injected energy includes thermal and magnetic energy. In an exemplary embodiment, the injected energy includes thermal and electromagnetic energy. In an exemplary embodiment, the injected energy includes thermal and acoustic energy. In an exemplary embodiment, the injected energy includes thermal and vibrational energy.

A tubular assembly has been described that includes a first tube, a second tube, a mechanical connection for coupling the first and second tubes, and a metallurgical connection for coupling the first and second tubes, wherein the metallurgical connection is provided proximate the mechanical connection.

A tubular assembly has been described that includes a first tube, a second tube, a mechanical connection for coupling the first and second tubes, and a metallurgical connection for coupling an external tubular surface of the first tube to an internal tubular surface of the second tube.

A tubular assembly has been described that includes a first tube, a second tube, a mechanical connection for coupling the first and second tubes, and a metallurgical connection for coupling an external surface of the first tube to an internal surface of the second tube, wherein the metallurgical connection is positioned within the mechanical connection.

A tubular assembly has been described that includes a first tube, a second tube, a threaded connection for coupling the first and second tubes, and a metallurgical connection for coupling an external surface of the first tube to an internal surface of the second tube, wherein the metallurgical connection is positioned within the threaded connection.

A cold-weldable insert for forming a metallurgical bond between overlapping threaded ends of adjacent tubular members has been described that includes a tapered tubular member comprising one or more threaded portions for engaging the threaded ends of the adjacent tubular members, wherein the tapered tubular member is fabricated from one or more materials capable of forming a metallurgical bond with at least one of the adjacent tubular members when energy is input into the tapered tubular member. In an exemplary embodiment, the injected energy is thermal energy. In an exemplary embodiment, the injected energy is mechanical energy. In an exemplary embodiment, the injected energy is electrical energy. In an exemplary embodiment, the injected energy is magnetic energy. In an exemplary embodiment, the injected energy is electromagnetic energy. In an exemplary embodiment, the injected energy is acoustic energy. In an exemplary embodiment, the injected energy is vibrational energy.

A method of radially expanding and plastically deforming a first tube having first threads, and a second tube having second threads has been described that includes coupling the first threads to the second threads to form a threaded connection, and radially expanding and plastically deforming the coupled first and second tubes and forming a metallurgical bond between the first and second tubes. In an exemplary embodiment, coupling the first threads to the second threads includes placing an insert material within the threaded connection. In an exemplary embodiment, the insert material includes a material capable of increasing a coefficient of friction between the first and second tubes during the radial expansion and plastic deformation of the first and second tubes. In an exemplary embodiment, the method further includes placing the coupled first and second tubes within a preexisting structure before radially expanding and plastically deforming the coupled first and second tubes. In several exemplary embodiments, the preexisting structure is a wellbore casing, a pipeline, a structural support.

An expandable tubular liner has been described that includes a first tube having first threads, and a second tube having second threads coupled to the first threads; wherein the first threads are metallurgically bonded to the second threads by the process of: coupling the first threads to the second threads; and radially expanding and plastically deforming the coupled first and second tubes. in an exemplary embodiment, coupling the first threads to the second threads includes placing an insert material within the threaded connection. In an exemplary embodiment, the insert material is a material capable of increasing a coefficient of friction between the first and second tubes during the radial expansion and plastic deformation of the coupled first and second tubes.

An apparatus has been described that includes a preexisting structure coupled to a tubular liner, the tubular liner comprising a first tube including first threads, and a second tube including second threads, wherein the tubular liner is coupled to the preexisting structure by the process of: coupling the first threads to the second threads to form a threaded connection; and radially expanding the coupled first and second tubes into contact with the preexisting structure and forming a metallurgical bond between the first insert and at least one of the first and second tubes. In an exemplary embodiment, coupling the first insert to the first threads comprises placing an insert material within a portion of the threaded connection. In an exemplary embodiment, the insert material is a material capable of increasing a coefficient of friction between the first and second tubes during the radial expansion and plastic deformation of the first and second tubes. In an exemplary embodiment, the preexisting structure is a wellbore casing. In an exemplary embodiment, the preexisting structure is a pipeline. In an exemplary embodiment, the preexisting structure is a structural support.

A method of radially expanding and plastically deforming a first tube, a second tube, and a mechanical coupling for coupling overlapping ends of the first and second tubes has been described that includes radially expanding and plastically deforming the coupled first and second tubes, and injecting energy into the coupled first and second tubes to form a metallurgical bond between the first and second tubes. In an exemplary embodiment, the energy is injected into the coupled first and second tubes prior to the radial expansion and plastic deformation of the first and second tubes. In an exemplary embodiment, the energy is injected into the coupled first and second tubes during the radial expansion and plastic deformation of the first and second tubes. In an exemplary embodiment, the energy is injected into the coupled first and second tubes after the radial expansion and plastic deformation of the first and second tubes. In an exemplary embodiment, the energy is injected into the coupled first and second tubes prior to and during the radial expansion and plastic deformation of the first and second tubes. In an exemplary embodiment, the energy is injected into the coupled first and second tubes during and after the radial expansion and plastic deformation of the first and second tubes. In an exemplary embodiment, the energy is injected into the coupled first and second tubes prior to and after the radial expansion and plastic deformation of the first and second tubes. In an exemplary embodiment, the energy is injected into the coupled first and second tubes prior to, during, and after the radial expansion and plastic deformation of the first and second tubes. In an exemplary embodiment, coupling the first and second tubes comprises placing an insert material between the overlapping ends of the first and second tubes. In an exemplary embodiment, the insert material is a material capable of increasing a coefficient of friction between the first and second tubes during the injection of energy into the first and second tubes. In an exemplary embodiment, the method further includes placing the coupled first and second tubes within a preexisting structure before radially expanding and plastically deforming the coupled first and second tubes. In an exemplary embodiment, the preexisting structure is a wellbore casing. In an exemplary embodiment, the preexisting structure is a pipeline. In an exemplary embodiment, the preexisting structure is a structural support. In an exemplary embodiment, the injected energy is thermal energy. In an exemplary embodiment, the injected energy is mechanical energy. In an exemplary embodiment, the injected energy is electrical energy. In an exemplary embodiment, the injected energy is magnetic energy. In an exemplary embodiment, the injected energy is electromagnetic energy. In an exemplary embodiment, the injected energy is acoustic energy. In an exemplary embodiment, the injected energy is vibrational energy.

An expandable tubular liner has also been described that includes a first tube, a second tube, and a mechanical coupling for coupling overlapping ends of the first and second tubes, wherein overlapping ends of the first and second tubes are metallurgically bonded by the process of: coupling the overlapping ends of the first and second tubes, radially expanding and plastically deforming the coupled first and second tubes, and injecting energy into the coupled first and second tubes. In an exemplary embodiment, the energy is injected into the coupled first and second tubes prior to the radial expansion and plastic deformation of the first and second tubes. In an exemplary embodiment, the energy is injected into the coupled first and second tubes during the radial expansion and plastic deformation of the first and second tubes. In an exemplary embodiment, the energy is injected into the coupled first and second tubes after the radial expansion and plastic deformation of the first and second tubes. In an exemplary embodiment, the energy is injected into the coupled first and second tubes prior to and during the radial expansion and plastic deformation of the first and second tubes. In an exemplary embodiment, the energy is injected into the coupled first and second tubes during and after the radial expansion and plastic deformation of the first and second tubes. In an exemplary embodiment, the energy is injected into the coupled first and second tubes prior to and after the radial expansion and plastic deformation of the first and second tubes. In an exemplary embodiment, the energy is injected into the coupled first and second tubes prior to, during, and after the radial expansion and plastic deformation of the first and second tubes. In an exemplary embodiment, coupling the overlapping ends of the first and second tubes includes placing an insert material between the overlapping ends of the first and second tubes. In an exemplary embodiment, the insert material comprises a material capable of increasing a coefficient of friction between the first and second tubes during the injection of energy into the first and second tubes. In an exemplary embodiment, the liner further includes placing the coupled first and second tubes within a preexisting structure before radially expanding and plastically deforming the coupled first and second tubes. In an exemplary embodiment, the preexisting structure is a wellbore casing. In an exemplary embodiment, the preexisting structure is a pipeline. In an exemplary embodiment, the preexisting structure is a structural support. In an exemplary embodiment, the injected energy is thermal, mechanical, electrical, magnetic, electromagnetic, acoustic, and/or vibrational energy.

An apparatus has been described that includes a preexisting structure coupled to a tubular liner, the tubular liner comprising a first tube, a second tube, and a mechanical coupling for coupling overlapping ends of the first and second tubes, wherein the tubular liner is coupled to the preexisting structure by the process of: radially expanding the coupled first and second tubes into contact with the preexisting structure, and injecting energy into the coupled first and second tubes to form a metallurgical bond between the first and second tubes. In an exemplary embodiment, the energy is injected into the coupled first and second tubes prior to the radial expansion and plastic deformation of the first and second tubes. In an exemplary embodiment, the energy is injected into the coupled first and second tubes during the radial expansion and plastic deformation of the first and second tubes. In an exemplary embodiment, the energy is injected into the coupled first and second tubes after the radial expansion and plastic deformation of the first and second tubes. In an exemplary embodiment, the energy is injected into the coupled first and second tubes prior to and during the radial expansion and plastic deformation of the first and second tubes. In an exemplary embodiment, the energy is injected into the coupled first and second tubes during and after the radial expansion and plastic deformation of the first and second tubes. In an exemplary embodiment, the energy is injected into the coupled first and second tubes prior to and after the radial expansion and plastic deformation of the first and second tubes. In an exemplary embodiment, the energy is injected into the coupled first and second tubes prior to, during, and after the radial expansion and plastic deformation of the first and second tubes. In an exemplary embodiment, coupling the overlapping ends of the first and second tubes includes placing an insert material between the overlapping ends of the first and second tubes. In an exemplary embodiment, the insert material includes a material capable of increasing a coefficient of friction between the first and second tubes during the injection of energy into the first and second tubes. In an exemplary embodiment, the apparatus further includes placing the coupled first and second tubes within a preexisting structure before radially expanding and plastically deforming the coupled first and second tubes. In several exemplary embodiments, the preexisting structure is a wellbore casing, a pipeline, and/or a structural support. In several exemplary embodiments, the injected energy includes thermal, mechanical, electrical, magnetic, electromagnetic, acoustic, and/or vibrational energy.

A method of radially expanding and plastically deforming a first tube, a second tube, and a mechanical coupling for coupling overlapping ends of the first and second tubes has been described that includes positioning an insert material between the overlapping ends of the coupled first and second tubes, radially expanding and plastically deforming the coupled first and second tubes, injecting energy into the coupled first and second tubes before, during, or after the radial expansion and plastic deformation of the first and second tubes to lower a melting point of at least a portion of the insert material, and injecting thermal energy into the coupled first and second tubes to form a metallurgical bond between the insert material and at least one of the first and second coupled tubes.

An expandable tubular liner has been described that includes a first tube, a second tube, and a mechanical coupling for coupling overlapping ends of the first and second tubes, wherein overlapping ends of the first and second tubes are metallurgically bonded by the process of: positioning an insert material between the overlapping ends of the coupled first and second tubes, radially expanding and plastically deforming the coupled first and second tubes, injecting energy into the coupled first and second tubes before, during, or after the radial expansion and plastic deformation of the first and second tubes to lower a melting point of at least a portion of the insert material, and injecting thermal energy into the coupled first and second tubes to form a metallurgical bond between the insert material and the first and second coupled tubes.

An apparatus has been described that includes a preexisting structure coupled to a tubular liner, the tubular liner comprising a first tube, a second tube, and a mechanical coupling for coupling overlapping ends of the first and second tubes, wherein the tubular liner is coupled to the preexisting structure by the process of: positioning an insert material between the overlapping ends of the coupled first and second tubes, radially expanding and plastically deforming the coupled first and second tubes into engagement with the preexisting structure, injecting energy into the coupled first and second tubes before, during, or after the radial expansion and plastic deformation of the first and second tubes to lower a melting point of at least a portion of the insert material, and injecting thermal energy into the coupled first and second tubes to form a metallurgical bond between the insert material and the first and second coupled tubes.

It is understood that variations may be made in the foregoing without departing from the scope of the invention. For example, the teachings of the present illustrative embodiments may be used to provide a wellbore casing, a pipeline, and/or a structural support. In addition, other types of inserts may be substituted for the cold-weldable inserts 730 and/or 930 that are capable of forming a metallurgical bond with the tubes 705 and/or 715 and/or 905 and/or 915 when energy is input into the inserts. Furthermore, other methods of inputting energy into the cold-weldable inserts 730 and/or 930 may substituted for, or used in addition to, the radial expansion and plastic deformation of the tubes 705 and 715 such as, for example, electrical, mechanical, thermal, vibrational, electro-magnetic, and/or magnetic energy, which may be injected into the inserts before and/or during and/or after the radial expansion and plastic deformation of the tubes. In addition, other forms of mechanical connections may used instead of, or in combination with, the threaded connections 218 and/or 725 and/or 925. Furthermore, one or more of the inserts 225 and/or 730 and/or 930 may be positioned proximate and/or within the threaded connections 218 and/or 725 and/or 925 in order to provide a metallurgical connection between the tubes 205 and/or 215 and/or 705 and/or 715 and/or 905 and/or 915. In addition, in an exemplary embodiment, one or more of the inserts, 730 and/or 930, may include a polymer adhesive that is activated to form a bond between the tubes 705 and/or 715 and/or 905 and/or 915 when energy is injected into the inserts. Examples of such polymer adhesives include, for example, anaerobic adhesives such those commercially available from Permabond L.L.C. Finally, the elements and teachings of the various illustrative embodiments may be combined in whole or in part in some or all of the illustrative embodiments.

Although this detailed description has shown and described illustrative embodiments of the invention, this description contemplates a wide range of modifications, changes, and substitutions. In some instances, one may employ some features of the present invention without a corresponding use of the other features. Accordingly, it is appropriate that readers should construe the appended claims broadly, and in a manner consistent with the scope of the invention.

What is claimed is:

1. A method of radially expanding and plastically deforming a first tube, a second tube, and a mechanical connection for coupling the first and second tubes, comprising:

coupling an insert to at least one of the first and second tubes, wherein the insert comprises an inner core comprised of a first material, and an outer layer comprised of a second material, and wherein the first material has a higher melting point than the second material;

coupling the first and second tubes together using the mechanical connection;

radially expanding and plastically deforming the coupled first and second tubes; and forming a metallurgical bond between the insert and at least one of the first and second tubes by injecting energy into the insert prior to radially expanding and plastically deforming the first and second tubes.

2. The method of claim 1, wherein the injected energy comprises thermal and mechanical energy.

3. The method of claim 1, wherein the injected energy comprises thermal and electrical energy.

4. The method of claim 1, wherein the injected energy comprises thermal and magnetic energy.

5. The method of claim 1, wherein the injected energy comprises thermal and electromagnetic energy.

6. The method of claim 1, wherein the injected energy comprises thermal and acoustic energy.

7. The method of claim 1, wherein the injected energy comprises thermal and vibrational energy.

8. The method of claim 1, wherein the insert comprises an outer layer of flux.

9. The method of claim 1, wherein the outer layer of the second material comprises an outer layer of flux.

10. The method of claim 1, wherein the first material is selected from the group consisting of aluminum, indium, bismuth, cadmium, lead, tin, brass, and bronze.

11. The method of claim 1, wherein the second material is selected from the group consisting of aluminum, indium, bismuth, cadmium, lead, tin, brass, and bronze.

12. A method of radially expanding and plastically deforming a first tube having first threads, and a second tube having second threads, comprising:

coupling a first insert to the first threads;

coupling the first threads to the second threads to form a threaded connection by placing the first insert within a portion of the first threads;

heating the threaded connection sufficiently to melt at least a portion of the first insert;

allowing the melted portion of the first insert to flow and solidify within the threaded connection;

placing the coupled first and second tubes within a preexisting structure; and then radially expanding and plastically deforming the coupled first and second tubes;

wherein the first insert comprises an inner core comprised of a first material, and an outer layer comprised of a second material, and wherein the first material has a higher melting point than the second material;

wherein the first insert comprises an outer layer of flux;

wherein the outer layer of the second material comprises an outer layer of flux;

wherein the first material is selected from the group consisting of aluminum, indium, bismuth, cadmium, lead, tin, brass, and bronze;

wherein the second material is selected from the group consisting of aluminum, indium, bismuth, cadmium, lead, tin, brass, and bronze; and wherein the preexisting structure is selected from the group consisting of a wellbore casing, a pipeline, and a structural support.

13. An expandable tubular liner comprising a first tube having first threads, and a second tube having second threads coupled to the first threads; wherein the first threads are coupled to the second threads by the process of:

coupling a first insert to the first threads;

coupling the first threads to the second threads;

wherein the first insert comprises an inner core comprised of a first material, and an outer layer comprised of a second material, and wherein the first material has a higher melting point than the second material;

wherein the first insert comprises an outer layer of flux;

wherein the outer layer of the second material comprises an outer layer of flux;

wherein the first material is selected from the group consisting of aluminum, indium, bismuth, cadmium, lead, tin, brass, and bronze; and wherein the second material is selected from the group consisting of aluminum, indium, bismuth, cadmium, lead, tin, brass, and bronze.

14. An apparatus comprising a preexisting structure coupled to a tubular liner, the tubular liner comprising a first tube including first threads, and a second tube including second threads, wherein the tubular liner is coupled to the preexisting structure by the process of:

coupling a first insert to the first threads;

coupling the first threads to the second threads to form a threaded connection by placing the first insert within a portion of the first threads;

heating the threaded connection sufficiently to melt at least a portion of the first insert;

allowing the melted portion of the first insert to flow and solidify within the threaded connection;

placing the coupled first and second tubes within a preexisting structure; and then radially expanding and plastically deforming the coupled first and second tubes;

wherein the first insert comprises an inner core comprised of a first material, and an outer layer comprised of a second material, and wherein the first material has a higher melting point than the second material;

wherein the first insert comprises an outer layer of flux;

wherein the outer layer of the second material comprises an outer layer of flux; wherein the first material is selected from the group consisting of aluminum, indium, bismuth, cadmium, lead, tin, brass, and bronze;

wherein the second material is selected from the group consisting of aluminum, indium, bismuth, cadmium, lead, tin, brass, and bronze; and wherein the preexisting structure is selected from the group consisting of a wellbore casing, a pipeline, and a structural support.

* * * * *